US012428694B2

(12) United States Patent
Yokoi et al.

(10) Patent No.: US 12,428,694 B2
(45) **Date of Patent: *Sep. 30, 2025**

(54) HOT-ROLLED STEEL SHEET AND METHOD FOR MANUFACTURING SAME

(71) Applicant: NIPPON STEEL CORPORATION, Tokyo (JP)

(72) Inventors: Tatsuo Yokoi, Tokyo (JP); Teruki Hayashida, Tokyo (JP); Mutsumi Sakakibara, Tokyo (JP); Jun Ando, Tokyo (JP); Shinsuke Kai, Tokyo (JP); Hiroshi Shuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1152 days.

This patent is subject to a terminal disclaimer.

(21) Appl. No.: 17/283,476

(22) PCT Filed: Oct. 21, 2019

(86) PCT No.: PCT/JP2019/041314
§ 371 (c)(1),
(2) Date: Apr. 7, 2021

(87) PCT Pub. No.: WO2020/080553
PCT Pub. Date: Apr. 23, 2020

(65) Prior Publication Data

US 2022/0010396 A1 Jan. 13, 2022

(30) Foreign Application Priority Data

Oct. 19, 2018 (JP) ..... 2018-197935

(51) Int. Cl.
*C21D 6/00* (2006.01)
*B21B 1/02* (2006.01)
(Continued)

(52) U.S. Cl.
CPC ..... *C21D 9/46* (2013.01); *B21B 1/02* (2013.01); *C21D 6/004* (2013.01); *C21D 6/005* (2013.01);
(Continued)

(58) Field of Classification Search
CPC ... C22C 38/001; C22C 38/002; C22C 38/005; C22C 38/008; C22C 38/02; C22C 38/04;
(Continued)

(56) References Cited

U.S. PATENT DOCUMENTS 6,517,955 B1 2/2003 Takada et al.
6,544,354 B1 4/2003 Kawano et al.
(Continued)

FOREIGN PATENT DOCUMENTS

CN 1310770 A 8/2001
CN 102834531 A 12/2012
(Continued)

OTHER PUBLICATIONS

"Geometrical Product Specifications (GPS)-Surface texture: Profile method-Terms, definitions and surface texture parameters", JIS B 0601: 2013, total of 24 pages.
(Continued)

*Primary Examiner* — Lois L Zheng
(74) *Attorney, Agent, or Firm* — Birch, Stewart, Kolasch & Birch, LLP

(57) ABSTRACT

This hot-rolled steel sheet has a predetermined chemical composition, and in a case where the thickness is denoted by t, the metallographic structure at a t/4 position from the surface contains one or both of tempered martensite and lower bainite at a volume percentage of 90% or more, the tensile strength is 980 MPa or more, and the average Ni concentration on the surface is 7.0% or more.

17 Claims, 3 Drawing Sheets

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/58*** | (2006.01) |
| ***C23G 1/08*** | (2006.01) |

(52) U.S. Cl.

CPC ..... *C21D 6/007* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/12* (2013.01); *C22C 38/14* (2013.01); *C22C 38/16* (2013.01); *C22C 38/58* (2013.01); *C23G 1/08* (2013.01); *B21B 2001/028* (2013.01); *C21D 2211/002* (2013.01); *C21D 2211/008* (2013.01)

(58) Field of Classification Search

CPC ..... C22C 38/06; C22C 38/08; C22C 38/105; C22C 38/12; C22C 38/14; C22C 38/16; C22C 38/18; C22C 38/58; C21D 2211/002; C21D 2211/004; C21D 2211/008; C21D 6/004; C21D 6/005; C21D 6/007; C21D 6/008; C21D 6/02; C21D 8/0205; C21D 8/021; C21D 8/0226; C21D 8/0263; C21D 8/0276; C21D 9/0081; C21D 9/46

See application file for complete search history.

(56) References Cited

U.S. PATENT DOCUMENTS

| | | | |
|---|---|---|---|
| 9,109,275 | B2 | 8/2015 | Morimoto et al. |
| 11,492,679 | B2 * | 11/2022 | Yokoi ..... C22C 38/008 |
| 2004/0163735 | A1 | 8/2004 | Matsukawa et al. |
| 2013/0048157 | A1 | 2/2013 | Ootsuka et al. |
| 2015/0030879 | A1 | 1/2015 | Kosaka et al. |
| 2015/0284818 | A1 | 10/2015 | Toyoda et al. |
| 2015/0329950 | A1 | 11/2015 | Azuma et al. |
| 2015/0376730 | A1 | 12/2015 | Shuto et al. |
| 2018/0100213 | A1 | 4/2018 | Tanaka et al. |
| 2019/0003009 | A1 | 1/2019 | Kawata et al. |

FOREIGN PATENT DOCUMENTS

| | | | | |
|---|---|---|---|---|
| CN | 108495943 | A | 9/2018 | |
| EP | 3 868 904 | A1 | 8/2021 | |
| JP | 59-219473 | A | 12/1984 | |
| JP | 6-145894 | A | 5/1994 | |
| JP | 11-61326 | A | 3/1999 | |
| JP | 2004-10954 | A | 1/2004 | |
| JP | 2004-218074 | A | 8/2004 | |
| JP | 2005-179703 | A | 7/2005 | |
| JP | 2008-202149 | A | 9/2008 | |
| JP | 2010-265537 | A | 11/2010 | |
| JP | 2012-251200 | A | 12/2012 | |
| JP | 2014173138 | A * | 9/2014 | ..... C23C 2/06 |
| JP | 2015-124410 | A | 7/2015 | |
| KR | 10-1996119 | B1 | 7/2019 | |
| WO | WO 2014/132968 | A1 | 9/2014 | |
| WO | WO 2016/167313 | A1 | 10/2016 | |

OTHER PUBLICATIONS

"Iron and steel-General rules for analytical methods", JIS G 1201: 2014, total of 17 pages.

"Metallic materials—Tensile testing-Method of test at room temperature", JIS Z 2241: (2011), total of 23 pages.

"Method for Charpy pendulum impact test of metallic materials", JIS Z 2242: (2005), total of 12 pages.

"Methods of salt spray testing", JIS Z 2371: 2015 (2000), total of 7 pages.

"Pressure sensitive adhesive cellophane tapes", JIS Z 1522: 2009, total of 5 pages.

"Metallic materials—Hole expanding test", JIS Z 2256, 2010, total 3 pages.

"Metallic materials—Tensile testing-Method of test at room temperature", JIS Z 2241, 2011, total 37 pages.

"Methods of salt spray testing", JIS Z 2371, 2015, total 38 pages.

* cited by examiner

| BASE STEEL SHEET Ni CONTENT | PREHEATING ZONE AIR RATIO 1.1 to 1.9 | PREHEATING ZONE AIR RATIO LESS THAN 1.1 |
|---|---|---|
| 0.01% |  |  |
| 0.02% |  |  |
| 0.04% |  |  |

HOT-ROLLED STEEL SHEET AND METHOD FOR MANUFACTURING SAME

TECHNICAL FIELD OF THE INVENTION

The present invention relates to a hot-rolled steel sheet and a method for manufacturing the same.

The present application claims priority based on Japanese Patent Application No. 2018-197935, filed in Japan on Oct. 19, 2018, the content of which is incorporated herein by reference.

RELATED ART

Recently, in order to reduce the amount of carbon dioxide gas ($CO_2$) emitted from a vehicle, reduction of weight of a vehicle body is promoted by using a high strength steel sheet. Further, in order to secure the safety of passengers, a high strength steel sheet has become widely used, in addition to a soft steel sheet, for a vehicle body.

Furthermore, recently, due to further tightening of fuel consumption regulations and environmental regulations for $NO_x$ or the like, the increase in plug-in hybrid vehicles and electric vehicles has been expected. In these next-generation vehicles, it is necessary to mount a large capacity battery, and it is necessary to further reduce the weight of the vehicle body.

In order to further reduce the weight of the vehicle body, the replacement from a steel sheet to a light-weight material such as an aluminum alloy, a resin, and CFRP or further high-strengthening of a steel sheet may be an option. However, from the viewpoint of material cost and working cost, it is realistic to use an ultrahigh-strength steel sheet for popular cars on the assumption of mass production excluding luxury cars.

Regarding weight reduction of a vehicle body, for example, a 780 MPa class high strength steel sheet is conventionally used for a center pillar, which is a frame component. However, recently, in order to further reduce the weight of a vehicle body, a 1180 MPa class ultrahigh-strength steel sheet having a thin sheet thickness has been used. In addition, a 590 MPa class high strength hot-rolled steel sheet is conventionally used for a lower arm, which is a suspension component. However, for example, as described in Patent Document 1, an ultrahigh-strength hot-rolled steel sheet of 980 MPa class or higher is required.

On the other hand, recently, Life Cycle Assessment (LCA) has been attracting attention, and attention has been paid to the environmental load not only during driving of vehicles, but also during manufacture.

For example, in the coating of vehicle components, a zinc phosphate treatment, which is a kind of chemical conversion treatment, has been applied as a base treatment. The zinc phosphate treatment is low in cost and has excellent coating film adhesion and corrosion resistance. However, a zinc phosphate treatment liquid contains phosphoric acid as a main component and a metal component such as a zinc salt, a nickel salt, and a manganese salt. Therefore, there is a concern about the environmental load of phosphorus and metals of the waste liquid that is discarded after use. In addition, a large amount of sludge containing iron phosphate as a main component, which is precipitated in a chemical conversion treatment tank, has a large environmental load as industrial waste.

Therefore, recently, a zirconium-based chemical conversion treatment liquid has been used as a chemical conversion treatment liquid that can reduce the environmental load. The zirconium-based chemical conversion treatment liquid does not contain phosphate and does not require the addition of metal salts. Therefore, the amount of sludge generated is extremely small. For example, Patent Documents 2 and 3 describe techniques for forming a chemical conversion film on a metal surface using a zirconium chemical conversion treatment liquid.

PRIOR ART DOCUMENT

Patent Document

[Patent Document 1] Pamphlet of PCT International Publication No. WO2014/132968

[Patent Document 2] Japanese Unexamined Patent Application, First Publication No. 2004-218074

[Patent Document 3] Japanese Unexamined Patent Application, First Publication No. 2008-202149

DISCLOSURE OF THE INVENTION

Problems to be Solved by the Invention

Even when a zirconium-based chemical conversion treatment liquid is used, corrosion resistance and coating film adhesion comparable to a zinc phosphate chemical conversion treatment can be obtained with a conventional high strength steel sheet up to a strength class of 780 MPa. However, since the amount of alloy elements contained is large in an ultrahigh-strength steel sheet having a tensile strength of 980 MPa or more, zirconium-based chemical conversion crystals insufficiently adhere to the surface of the steel sheet, and thus good corrosion resistance and coating film adhesion cannot be obtained.

The present invention has been devised in view of the above-mentioned problems, and an object of the present invention is to provide a hot-rolled steel sheet which is an ultrahigh-strength steel sheet having a tensile strength of 980 MPa or more and sufficient low temperature toughness, and even in a case where a zirconium-based chemical conversion treatment liquid is used, has chemical convertibility and coating film adhesion equal to or higher than those in a case where a zinc phosphate chemical conversion treatment liquid is used, and a method for manufacturing the hot-rolled steel sheet capable of stably manufacturing the hot-rolled steel sheet.

Means for Solving the Problem

The present inventors have conducted an intensive investigation to solve the above problems, and have found that the oxides on the surface layer of the steel sheet have a great effect on chemical convertibility and coating film adhesion, as will be described later.

The present invention has been made based on these findings, and the gist thereof is as follows.

(1) A hot-rolled steel sheet according to an aspect of the present invention includes, as a chemical composition expressed by an average value in an entire sheet thickness direction, by mass %: C: 0.050% or more and 0.200% or less; Si: 0.05% or more and 3.00% or less; Mn: 1.00% or more and 4.00% or less; Al: 0.001% or more and 2.000% or less; N: 0.0005% or more and 0.1000% or less; Ni: 0.02% or more and 2.00% or less; Nb: 0% or more and 0.300% or less; Ti: 0% or more and 0.300% or less; Cu: 0% or more and 2.00% or less; Mo: 0% or more and 1.000% or less; V: 0% or more and 0.300% or less; Cr: 0% or more and 2.00% or less; Mg: 0% or more and 0.0100% or less; Ca: 0% or more and 0.0100% or less; REM: 0% or more and 0.1000% or less; B: 0% or more and 0.0100% or less; one or two or more of Zr, Co, Zn, and W: 0% to 1.000% in total; Sn: 0% to 0.050%; P: 0.100% or less; S: 0.0300% or less; O: 0.0100% or less; and a remainder including Fe and impurities, in which Expression (i) is satisfied, PCM represented by Expression (ii) is 0.20 or more, Ms represented by Expression (iii) is 400° C. or higher, in a case where a thickness is denoted by t, a metallographic structure at a t/4 position from a surface contains one or both of tempered martensite and lower bainite at a total volume percentage of 90% or more, a tensile strength is 980 MPa or more, and an average Ni concentration on the surface is 7.0% or more, $$0.05\% \leq Si+Al \leq 2.50\% \quad \text{Expression (i)}$$

$$PCM=C+Si/30+Mn/20+Cu/20+Ni/60+Mo/15+Cr/20+V/10+5\times B \quad \text{Expression (ii)}$$

$$Ms=561-474\times C-33\times Mn-17\times Ni-17\times Cr-21\times Mo \quad \text{Expression (iii)}$$

where a symbol of each element shown in the expressions indicates mass % of the element contained in the hot-rolled steel sheet.

(2) The hot-rolled steel sheet according to (1) may contain, as the chemical composition, by mass %, Ni: 0.02% or more and 0.05% or less.

(3) In the hot-rolled steel sheet according to (1) or (2), the average number density of iron-based carbides present in the tempered martensite and the lower bainite may be $1.0\times10^6$ carbides/$mm^2$ or more.

(4) In the hot-rolled steel sheet according to any one of (1) to (3), an internal oxide layer may be present in the hot-rolled steel sheet, and the average depth of the internal oxide layer may be 5.0 μm or more and 20.0 μm or less from the surface of the hot-rolled steel sheet.

(5) In the hot-rolled steel sheet according to any one of (1) to (4), the standard deviation of an arithmetic average roughness Ra of the surface of the hot-rolled steel sheet may be 10.0 μm or more and 50.0 μm or less.

(6) The hot-rolled steel sheet according to any one of (1) to (5) may contain, as the chemical composition, by mass %, one or both of B: 0.0001% or more and 0.0100% or less, and Ti: 0.015% or more and 0.300% or less.

(7) In the hot-rolled steel sheet according to any one of (1) to (6) may contain, as the chemical composition, by mass %, one or two or more of Nb: 0.005% or more and 0.300% or less, Cu: 0.01% or more and 2.00% or less, Mo: 0.010% or more and 1.000% or less, V: 0.010% or more and 0.300% or less, and Cr: 0.01% or more and 2.00% or less.

(8) In the hot-rolled steel sheet according to any one of (1) to (7) may contain, as the chemical composition, by mass %, one or two or more of Mg: 0.0005% or more and 0.0100% or less, Ca: 0.0005% or more and 0.0100% or less, and REM: 0.0005% or more and 0.1000% or less.

(9) A method for manufacturing a hot-rolled steel sheet according to another aspect of the present invention includes: casting a molten steel having the chemical composition according to (1) to obtain a slab; heating the slab in a heating furnace which includes a regenerative-type burner and has at least a preheating zone, a heating zone, and a soaking zone; hot-rolling the heated slab so that a finish rolling temperature is 850° C. or higher to obtain a hot-rolled steel sheet; performing primary cooling on the hot-rolled steel sheet to a temperature range equal to or lower than a Ms point temperature calculated by Expression (iv) so that an average cooling rate from the finish rolling temperature to the Ms point temperature is 50° C./sec or higher; and coiling the hot-rolled steel sheet at a temperature of lower than 350° C., in which in the heating of the slab, an air ratio in the preheating zone is 1.1 or more and 1.9 or less.

$$Ms=561-474\times C-33\times Mn-17\times Ni-17\times Cr-21\times Mo \quad \text{Expression (iv)}$$

(10) In the method for manufacturing a hot-rolled steel sheet according to (9), the primary cooling may be stopped at a temperature lower than the Ms point temperature and 350° C. or higher, and the hot-rolled steel sheet after the primary cooling may be cooled at a temperature of lower than 350° C. so that a maximum cooling rate is lower than 50° C./sec.

(11) In the method for manufacturing a hot-rolled steel sheet according to (9) or (10), in the heating of the slab, an air ratio in the heating zone may be 0.9 or more and 1.3 or less.

(12) In the method for manufacturing a hot-rolled steel sheet according to any one of (9) to (11), in the heating of the slab, an air ratio in the soaking zone may be 0.9 or more and 1.9 or less.

(13) In the method for manufacturing a hot-rolled steel sheet according to (11) or (12), the air ratio in the preheating zone may be higher than the air ratio in the heating zone.

(14) The method for manufacturing a hot-rolled steel sheet according to any one of (9) to (13) may further include pickling the hot-rolled steel sheet after the coiling of the hot-rolled steel sheet using a 1 to 10 wt % hydrochloric acid solution at a temperature of 20° C. to 95° C. under a condition of a pickling time of 30 seconds or more and less than 60 seconds.

Effects of the Invention

According to the above aspects of the present invention, it is possible to obtain a hot-rolled steel sheet which is an ultrahigh-strength steel sheet having a tensile strength of 980 MPa or more and good low temperature toughness, and even in a case where a zirconium-based chemical conversion treatment liquid is used, has chemical convertibility and coating film adhesion equal to or higher than those in a case where a zinc phosphate chemical conversion treatment liquid is used. Since the steel sheet according to the present invention has excellent chemical convertibility and coating film adhesion, the steel sheet has excellent corrosion resistance after coating. Therefore, the steel sheet according to the present invention is suitable for a component for a vehicle that requires high strength and corrosion resistance after coating.

EMBODIMENTS OF THE INVENTION

Figure 1:
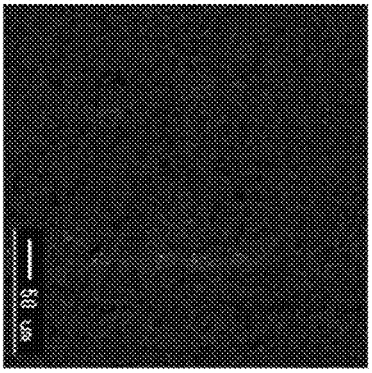
FIG. 1 is an example of EPMA measurement results of a surface of a hot-rolled steel sheet according to the embodiment and a comparative hot-rolled steel sheet (measurement conditions: acceleration voltage: 15 kV, irradiation current: $6\times10^{-8}$ A, irradiation time: 30 ms, and beam diameter: 1 μm).
Figure 1:
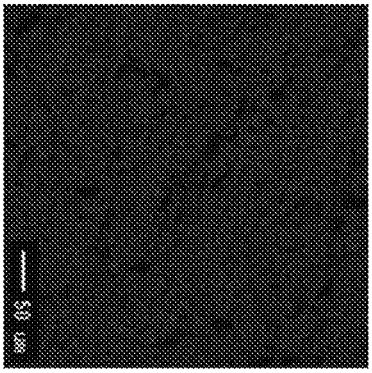
Figure 1:
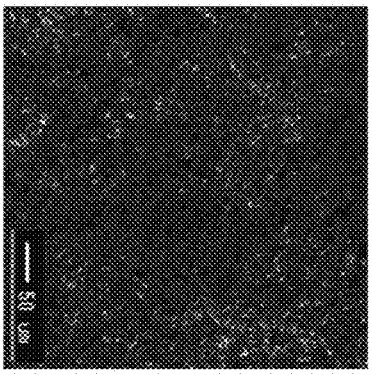
Figure 1:
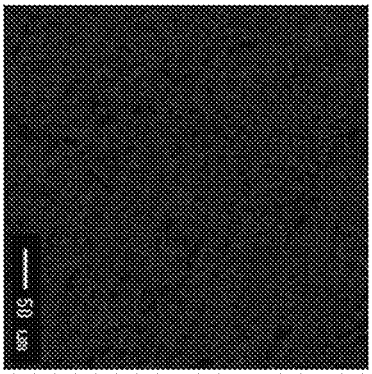
Figure 1:
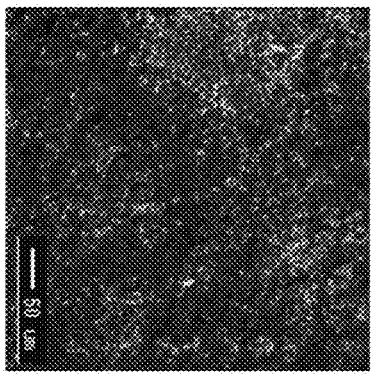
Figure 1:
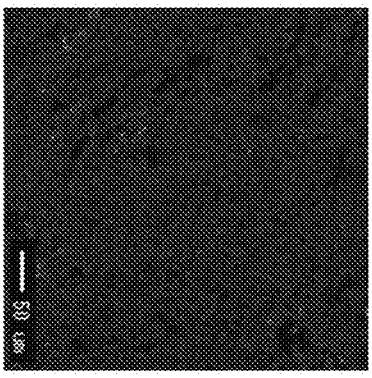
Figure 1:
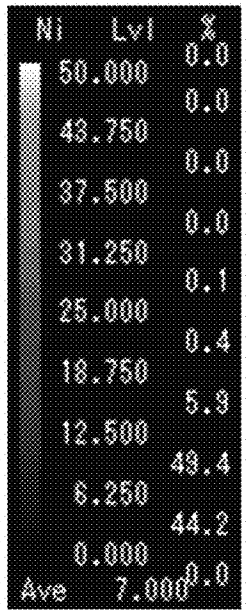

The present inventors have conducted an intensive investigation on the conditions under which good chemical convertibility and coating film adhesion can be stably obtained by a chemical conversion treatment using a zirconium-based chemical conversion treatment liquid on an ultrahigh-strength steel sheet having a tensile strength of 980 MPa or more. As a result of the investigation, it has been found that the oxide on the surface layer of the steel sheet has a great effect on chemical convertibility and coating film adhesion. The details are as follows.

A steel sheet is usually pickled before the chemical conversion treatment is performed. However, even when ordinary pickling is performed, oxides of Si, Al, and the like are formed on the surface of an ultrahigh-strength steel sheet, which deteriorates chemical convertibility in the zirconium-based chemical conversion treatment and coating film adhesion. As a result of further investigation conducted by the present inventors, it has been found that in order to improve the chemical convertibility and the coating film adhesion, it is effective to form a layer having a Ni concentrated portion (sometimes referred to as a Ni concentrated layer) near the surface of the steel sheet as a precipitation nucleus of a zirconium-based chemical conversion crystal while suppressing the formation of oxides of Si, Al, and the like.

In addition, the present inventors have found that in a case where low cost and mass production are assumed in a step of manufacturing a general hot-rolled steel sheet, it is possible to form a Ni concentrated layer near the surface of the steel sheet after pickling (before a chemical conversion treatment) by containing the small amount of Ni and limiting the heating conditions in a heating step before hot rolling.

Hereinafter, a hot-rolled steel sheet according to an embodiment will be described in detail.

[Composition of Steel Sheet]

First, the reason for limiting the chemical composition of the hot-rolled steel sheet according to the embodiment will be described. Unless otherwise specified, % with respect to the amount of the component indicates mass %.

In addition, the display of the element name used in each expression in the present specification indicates the amount (mass %) of the element in the steel sheet, and in a case where the element is not contained, 0 is substituted.

C: 0.050% or More and 0.200% or Less

C is one of the important elements in the hot-rolled steel sheet according to the embodiment. C is an element that contributes to an increase in the strength and hardenability of the steel sheet. When the C content is less than 0.050%, the effect of improving the strength by structure strengthening of the low temperature transformation generating phase cannot be obtained. Therefore, the C content is set to 0.050% or more. The C content is preferably 0.070% or more.

On the other hand, C forms iron-based carbide such as cementite ($Fe_3C$) that is precipitated when bainite and martensite are tempered. When the C content is more than 0.200%, the amount of iron-based carbide such as cementite ($Fe_3C$) which become the origins of cracks of the secondary sheared surface at the time of punching is increased and formability such as hole expansibility is deteriorated. Therefore, the C content is set to 0.200% or less. The C content is preferably 0.180% or less.

Si: 0.05% or More and 3.00% or Less

Si is one of the important elements in the hot-rolled steel sheet according to the embodiment. Si is an element that contributes to improvement in the strength of the base metal by improving the temper softening resistance, and is also an effective element as a deoxidizing material for molten steel. In addition, Si is also an effective element for suppressing the occurrence of scale related defects such as scale and spindle scale. In order to obtain these effects, the Si content is set to 0.05% or more. Further, as the Si content increases, the precipitation of iron-based carbide such as cementite in the material structure is suppressed, and thus the strength and hole expansibility are improved. Therefore, the Si content is preferably set to 0.10% or more.

On the other hand, even when the Si content is more than 3.00%, the effect of contributing to an increase in strength is saturated. Therefore, the Si content is set to 3.00% or less. The Si content is preferably 2.50% or less.

Mn: 1.00% or More and 4.00% or Less

Mn is an element that contributes to solid solution strengthening. In addition, Mn is an element that enhances hardenability, and is contained in order that the steel sheet structure has a primary phase of tempered martensite or lower bainite. When the Mn content is less than 1.00%, the effect of suppressing ferritic transformation and bainitic transformation during cooling is not sufficiently exhibited, and the steel sheet structure cannot have a primary phase of martensite and/or lower bainite. Therefore, the Mn content is set to 1.00% or more.

On the other hand, even when the Mn content is more than 4.00%, this effect is saturated. Therefore, the Mn content is set to 4.00% or less. In addition, when the Mn content is more than 3.00%, slab cracks are likely to occur at the time of casting. Therefore, the Mn content is preferably 3.00% or less.

Al: 0.001% or More and 2.000% or Less

Al is one of the important elements in the hot-rolled steel sheet according to the embodiment. Al is an element that suppresses the formation of coarse cementite when bainite and martensite are tempered, and improves the hole expansibility. In addition, Al can also be used as a deoxidizing material. In order to obtain this effect, the Al content is set to 0.001% or more.

On the other hand, the excessive Al content increases the number of Al-based coarse inclusions, which causes deterioration of hole expansibility and a surface flaw. Thus, the Al content is set to 2.000% or less. In addition, when the Al content is high, the tundish nozzle is likely to be blocked at the time of casting, and thus the Al content is preferably 1.500% or less.

N: 0.0005% or More and 0.1000% or Less

When the N content is high, solute N remains in the steel and the ductility is decreased. In addition, in a case where Ti is contained, coarse TiN is precipitated and the hole expansibility is decreased. Therefore, the smaller the N content is, the more preferable it is. When the N content is more than 0.1000%, particularly, the ductility and the hole expansibility are significantly decreased, and thus the N content is set to 0.1000% or less. The N content is preferably 0.0100% or less.

On the other hand, it is economically undesirable to set the N content to less than 0.0005%. Therefore, the N content is set to 0.0005% or more.

Ni: 0.02% or More and 2.00% or Less

Ni is one of the important elements in the hot-rolled steel sheet according to the embodiment. Ni is concentrated in the vicinity of the surface of the steel sheet near the interface between the surface of the steel sheet and the scale under specific conditions mainly in the heating step of the hot rolling step. When the zirconium-based chemical conversion treatment is performed on the surface of the steel sheet, this Ni acts as a precipitation nucleus of the zirconium-based chemical conversion film, and promotes the formation of a film having no lack of hiding and good adhesion. When the Ni content is less than 0.02%, the effect is not exhibited and thus the Ni content is set to 0.02% or more. The above effect of improving adhesion can be obtained not only for a zirconium-based chemical conversion film, but also for a conventional zinc phosphate chemical conversion film. In addition, the adhesion to the hot-dip galvanized layer by hot-dip galvanizing and the base metal of the alloyed galvanized layer that is alloyed after plating is also improved.

Further, Ni is an element that enhances hardenability and is an element effective for suppressing ferritic transformation at the time of cooling and for making the steel sheet structure to be a tempered martensite or lower bainite structure.

On the other hand, when the Ni content is more than 2.00%, not only the effect is saturated, but also the alloy cost is increased. Therefore, the Ni content is set to 2.00% or less. The Ni content is preferably 0.50% or less and more preferably 0.05% or less.

The chemical composition described above is the basic chemical composition of the hot-rolled steel sheet according to the embodiment. The hot-rolled steel sheet according to the embodiment may contain the above elements and the remainder may be composed of Fe and impurities. However, for the purpose of improving various properties, the following components can be further contained. Since the following elements do not necessarily have to be contained, the lower limit of the amount is 0%.

Nb: 0% or More and 0.300% or Less

Nb is an element that contributes to improvement in low temperature toughness through the refinement of the grain size of the hot-rolled steel sheet by forming carbonitride or delaying the grain growth at the time of hot rolling by solute Nb. In a case where this effect is obtained, the Nb content is preferably set to 0.005% or more.

On the other hand, even when the Nb content is more than 0.300%, the above effect is saturated and the economic efficiency is decreased. Therefore, even in a case where Nb is contained as necessary, the Nb content is set to 0.300% or less.

Ti: 0% or More and 0.300% or Less

Ti is an element that contributes to improvement in low temperature toughness through the refinement of the grain size of the hot-rolled steel sheet by forming carbonitride or delaying the grain growth at the time of hot rolling by solute Ti. In a case of obtaining this effect, the Ti content is preferably set to 0.005% or more. In addition, in order to exhibit the effect of improving the hardenability by containing B, it is necessary to reduce the amount of B precipitated as BN as much as possible. In a case where the Ti content is set to 0.015% or more, TiN which is more stable at a high temperature than BN is precipitated and thus sufficient improvement in hardenability by solute B can be expected. Therefore, in a case where B is contained at the same time, the Ti content is preferably set to 0.015% or more.

On the other hand, even when the Ti content is more than 0.300%, the above effect is saturated and the economic efficiency is decreased. Therefore, the Ti content is set to 0.300% or less even in a case where Ti is contained as necessary.

Cu: 0% or more and 2.00% or less

Mo: 0% or more and 1.000% or less

V: 0% or more and 0.300% or less

Cr: 0% or more and 2.00% or less

Cu, Mo, V, and Cr are elements that enhance hardenability, and one or two or more of these elements may be contained in order to suppress ferritic transformation at the time of cooling and make the steel sheet structure to be a tempered martensite or lower bainite structure. In addition, these elements are elements having an effect of improving the strength of the hot-rolled steel sheet by precipitation hardening or solid solution strengthening, and one or two or more thereof may be contained in order to obtain this effect. In order to obtain the above effects, it is preferable that the amount of each of Mo and V is set to 0.010% or more, and the amount of each of Cu and Cr is set to 0.01% or more.

On the other hand, even when the Cu content is more than 2.00%, the Mo content is more than 1.000%, the V content is more than 0.300%, or the Cr content is more than 2.00%, the above effects are saturated and the economic efficiency is decreased. Therefore, even in a case where Cu, Mo, V, and Cr are contained as necessary, the Cu content is set to 2.00% or less, the Mo content is set to 1.000% or less, the V content is set to 0.300% or less, and the Cr content is set to 2.00% or less.

Mg: 0% or More and 0.0100% or Less

Ca: 0% or More and 0.0100% or Less

REM: 0% or More and 0.1000% or Less

Mg, Ca, and REM (rare earth elements) are elements controlling the form of non-metal inclusions which become the origins of fracture and deteriorate the workability, and improve the workability of the steel sheet. Therefore, any one or two or more of these elements may be contained. In a case where this effect is obtained, the amount of each of Ca, REM, and Mg is preferably set to 0.0005% or more.

On the other hand, even when the Mg content is more than 0.0100%, the Ca content is more than 0.0100%, or the REM content is more than 0.1000%, the above effect is saturated and the economic efficiency is decreased. Therefore, even in a case where these elements are contained, it is desirable that the Mg content is 0.0100% or less, the Ca content is 0.0100% or less, and the REM content is 0.1000% or less.

Here, REM refers to a total of 17 elements made up of Sc, Y and lanthanoid, and the REM content refers to the total amount of these elements. In the case of lanthanoid, lanthanoid is industrially added in the form of misch metal.

B: 0% or More and 0.0100% or Less

B is an element that enhances hardenability and is an element effective for making the steel sheet structure to be a tempered martensite or lower bainite structure by delaying the ferritic transformation at the time of cooling, and may be contained in order to obtain this effect. In a case where this effect is obtained, the B content is preferably set to 0.0001% or more. The B content is more preferably 0.0005% or more and even more preferably 0.0007% or more.

On the other hand, when the B content is more than 0.0100%, not only the effect is saturated, but also the economic efficiency is decreased. Therefore, even in a case where B is contained, the B content is set to 0.0100% or less. The B content is preferably 0.0050% or less and more preferably 0.0030% or less.

Zr, Co, Zn, and W: One or Two or More Thereof in a Total of 0% to 1.000%

Sn: 0.050% or Less

Regarding other elements, even when Zr, Co, Zn, and W are contained in a total of 1.000% or less, the effect of the hot-rolled steel sheet according to the embodiment is not impaired. Therefore, the total amount of these elements may be 1.0000% or less.

In addition, even when a small amount of Sn is contained, the effect of the hot-rolled steel sheet according to the embodiment is not impaired. However, when the Sn content is more than 0.050%, flaws may be generated at the time of hot rolling and thus it is desirable to set the Sn content to 0.050% or less.

P: 0.100% or Less

P is an impurity contained in the molten iron and is an element that is segregated at the grain boundary of the steel sheet and decreases the low temperature toughness as the content increases. Therefore, the lower the P content is, the more desirable it is. When the P content is more than 0.100%, the workability and weldability are significantly adversely affected, and thus the P content is set to 0.100% or less. Particular, in a case in consideration of weldability, the P content is preferably 0.030% or less.

On the other hand, it is preferable that the P content is low. However, when the P content is reduced more than necessary, a great load is applied to the steelmaking step. Therefore, the P content may be 0.001% or more.

S: 0.0300% or Less

S is an impurity contained in the molten iron and is an element that causes cracks at the time of hot rolling when the S content is too high. In addition, S is an element that generates inclusions, such as MnS, which deteriorates the hole expansibility. Therefore, the S content has to be reduced as much as possible. However, when the S content is 0.0300% or less, the S content is within an acceptable range, and thus the S content is set to 0.0300% or less. However, from the viewpoint of hole expansibility, the S content is preferably 0.0100% or less and more preferably 0.0050% or less.

On the other hand, it is preferable that the S content is low. However, when the S content is reduced more than necessary, a great load is applied to the steelmaking step. Therefore, the S content may be 0.0001% or more.

O: 0.0100% or Less

O is an element that forms a coarse oxide, which becomes the origin of fracture in the steel and causes brittle fracture and hydrogen-induced cracks when the amount is too high. Therefore, the O content is set to 0.0100% or less. From the viewpoint of on-site weldability, the O content is preferably set to 0.0030% or less.

On the other hand, O is an element that disperses a large number of fine oxides when deoxidizing the molten steel. Therefore, the O content may be 0.0005% or more.

As described above, the hot-rolled steel sheet according to the embodiment contains basic elements and contains optional elements as necessary, and the remainder includes Fe and impurities. The impurities refer to components that are unintentionally contained in the steel sheet manufacturing process from raw materials or other manufacturing steps.

$0.05\% \leq Si+Al \leq 2.50\%$

In the hot-rolled steel sheet according to the embodiment, it is necessary to control the amount of each element to be within the above ranges and then control Si+Al so as to satisfy Expression (1).

$$0.05\% \leq Si+A1 \leq 2.50\% \quad \text{Expression (1)}$$

When Si+Al is less than 0.05%, scale related defects such as scale and spindle scale occur.

On the other hand, when Si+Al is more than 2.50%, even in a case where Ni is incorporated to sufficiently concentrate Ni on the surface layer, the effect that the Ni concentrated portion becomes the nucleus of the chemical conversion crystal cannot be obtained, and the effect of improving the chemical convertibility and the coating film adhesion cannot be obtained.

$PCM \geq 0.20$ $Ms \geq 400$ (° C.)

In addition, in the hot-rolled steel sheet according to the embodiment, it is necessary to control the amount of each element to be within the above ranges and to set PCM obtained by Expression (2) to 0.20 or more.

$$PCM = C + Si/30 + Mn/20 + Cu/20 + Ni/60 + Mo/15 + Cr/20 + V/10 + 5 \times B \quad \text{Expression (2)}$$

When the PCM is less than 0.20, the hardenability is not sufficient, and a microstructure having tempered martensite and/or lower bainite as the primary phase cannot be obtained.

In addition, in the hot-rolled steel sheet according to the embodiment, it is necessary to set Ms represented by Expression (3) to 400 (° C.) or higher.

When the Ms is lower than 400 (° C.), the auto temper (automatic tempering) during cooling it not sufficient and thus the stretch flangeability is deteriorated.

$$Ms = 561 - 474 \times C - 33 \times Mn - 17 \times Ni - 17 \times Cr - 21 \times Mo \quad \text{Expression (3)}$$

The amount of each element in the hot-rolled steel sheet described above is the average amount in the total sheet thickness obtained by ICP emission spectroscopic analysis using chips according to JIS G1201: 2014.

[Metallographic Structure]

The microstructure (metallographic structure) of the hot-rolled steel sheet according to the embodiment will be described. Unless otherwise specified, % with respect to the microstructure indicates % by volume percentage.

Total volume percentage of one or both of tempered martensite or lower bainite in metallographic structure at t/4 (t: sheet thickness) position from surface of steel sheet: 90% or more In the hot-rolled steel sheet according to the embodiment, the primary phase is set to tempered martensite and/or lower bainite, and the total volume percentage thereof is set to 90% or more.

When the total volume percentage of tempered martensite and lower bainite is less than 90%, a tensile strength of 980 MPa or more cannot be secured. Therefore, the lower limit of the total volume percentage of tempered martensite and lower bainite is 90%. Even when the volume percentage thereof is 100%, high strength and excellent low temperature toughness can be obtained.

In the hot-rolled steel sheet according to the embodiment, tempered martensite is the most important microstructure to have high strength and excellent low temperature toughness. The tempered martensite is an aggregation of lath-shaped crystal grains, and is a structure that contains iron-based carbides having a major axis of 5 nm or more inside thereof. Further, the iron-based carbides belong to plural variants, that is, a plurality of iron-based carbide groups extending in different directions.

The structure of the tempered martensite can be obtained in a case where a cooling rate at the time of a cooling in a rage of an martensitic transformation start temperature (Ms) point or less is decreased, and in a case where the steel sheet structure is tempered at 100° C. to 600° C. after the structure is once made to be a martensite structure. In the hot-rolled steel sheet according to the embodiment, precipitation is controlled by cooling control in a range of lower than 400° C.

The lower bainite is also an aggregation of lath-shaped crystal grains like the tempered martensite, and contains iron-based carbides having a major axis of 5 nm or more inside thereof. In the lower bainite, the carbides belong to a single variant, that is, an iron-based carbide group extending in the same direction. Whether the structure is the tempered martensite or the lower bainite can be easily distinguished by observing the extending direction of the iron-based carbide. Here, the iron-based carbide group extending in the same direction means one whose difference in the extending direction of the iron-based carbide group is within 5°. However, in the hot-rolled steel sheet according to the embodiment, it is not necessary to clearly distinguish between the tempered martensite and the lower bainite from the viewpoint of material.

The microstructure may contain one or two or more of ferrite, fresh martensite, upper bainite, pearlite, and retained austenite as structures other than tempered martensite and the lower bainite at a total volume percentage of 10% or less.

In the embodiment, the fresh martensite is defined as martensite which does not contain carbide. Therefore, the tempered martensite and the fresh martensite can be easily distinguished from the viewpoint of carbide. That is, the presence or absence of iron-based carbide can be distinguished by observing the inside of the lath-shaped crystal grains using FE-SEM. The fresh martensite has high strength but is deteriorated in the low temperature toughness. Therefore, it is necessary to limit the volume percentage to 10% or less.

The retained austenite is a structure in which austenite formed at the time of heating is not transformed to room temperature and remains, but when the steel is plastically deformed at the time of press forming or the vehicle member is plastically deformed at the time of collision, the retained austenite is transformed into the fresh martensite. Therefore, there is the similar adverse effect as the above fresh martensite. Thus, it is necessary to limit the volume percentage to 10% or less. In addition, since the crystal structure of the retained austenite is FCC and the other microstructure is BCC, which are different from each other, the volume percentage can be easily obtained by the X-ray diffraction method.

The upper bainite is an aggregation of lath-shaped crystal grains containing carbides between laths. In the upper bainite, the carbides are precipitated at the lath interface, and this case is clearly different from a case where the lower bainite in which carbides are precipitated inside the lath. Therefore, it is possible to easily determine the upper bainite. That is, the upper bainite can be determined based on the presence or absence of iron-based carbides by observing the interfaces of the lath-shaped crystal grains using FE-SEM. Since the carbides contained between the laths become the origins of fracture, the low temperature toughness is decreased when the volume percentage of the upper bainite is high. In addition, since the upper bainite is formed at high temperature compared to the lower bainite, the upper bainite has low strength. Accordingly, in a case where the upper bainite is excessively formed, it is difficult to secure a tensile strength of 980 MPa or more. Since this adverse effect becomes remarkable when the volume percentage of the upper bainite is more than 10%, it is necessary to limit the volume percentage to 10% or less.

The ferrite is a massive crystal grain and is a structure in which a substructure such as lath is not contained inside thereof. The ferrite is the softest structure, and it is necessary to limit the volume percentage to 10% or less in order to secure a tensile strength of 980 MPa or more. Further, since the ferrite is extremely soft as compared with the tempered martensite or the lower bainite as the primary phase, deformation is concentrated at the interface between the ferrite and the tempered martensite or the lower bainite and is likely to become the origin of fracture. Since this adverse effect becomes remarkable when the volume percentage is more than 10%, it is necessary to limit the volume percentage to 10% or less.

The pearlite has a lamellar metallographic structure in which cementite is precipitated in layers between the ferrite grains, and also causes to decrease the strength and to deteriorate the low temperature toughness as same as the ferrite. Thus, it is necessary to limit the volume percentage thereof to 10% or less.

The identification of tempered martensite, fresh martensite, upper bainite, lower bainite, ferrite, pearlite, retained austenite, and the remainder in the microstructure, which constitute the microstructure of the hot-rolled steel sheet according to the embodiment as described above, the confirmation of the presence positions thereof, and the measurement of the volume percentage thereof can be performed by corroding a cross section in a rolling direction of the steel sheet or a cross section in a direction orthogonal to the rolling direction using a Nital reagent and the reagent disclosed in Japanese Unexamined Patent Application, First Publication No. S59-219473 and observing the cross section using a scanning electron microscope and a transmission electron microscope at a magnification of 1000 to 100000 times.

In addition, the structures can also be distinguished by analysis of the crystal orientation using the FESEM-EBSP method or the measurement of the hardness of the micro region such as the measurement of micro Vickers hardness.

For example, as described above, the tempered martensite, the upper bainite, and the lower bainite are different in the formation site of the carbide and the crystal orientation relationship (extending directions) of the carbide, and thus it is possible to easily distinguish between the lower bainite and the tempered martensite by observing the iron-based carbide in lath-shaped crystal grains using FE-SEM and examining the extending directions thereof. However, in the hot-rolled steel sheet according to the embodiment, since the total volume percentage of the tempered martensite and the lower bainite may be controlled, it is not always necessary to distinguish between these structures.

In the hot-rolled steel sheet according to the embodiment, the volume percentages of the ferrite, the pearlite, the upper bainite, the lower bainite, and the tempered martensite are obtained by, in a case where the thickness of the steel sheet is denoted by t, collecting a sample from a portion (a range of about t/8 to 3t/8) including a t/4 position from the surface of the steel sheet in the thickness direction of the steel sheet and observing a cross section in the rolling direction of the steel sheet (so-called L-direction cross section).

Specifically, first, the sample is subjected to Nital etching, and a structure photograph obtained in a visual field of 300 μm×300 μm using an optical microscope after the etching is subjected to image analysis to obtain the area ratio of each of ferrite and pearlite and the total area ratio of bainite, martensite, and retained austenite. Next, the portion subjected to Nital etching is subjected to Lepera etching, and a structure photograph obtained in a visual field of 300 μm×300 μm using an optical microscope is subjected to image analysis to calculate a total area ratio of the retained austenite and the martensite. Further, a sample subjected to surface grinding up to a depth of ¼ of the sheet thickness from a normal direction of the rolled surface is used to obtain the area ratio of the retained austenite with X-ray diffraction measurement. By this method, the area ratio of each of ferrite, bainite, martensite, retained austenite, and pearlite can be obtained.

As described above, bainite is an aggregation of lath-shaped crystal grains. The bainite includes upper bainite which includes carbides between laths and is an aggregation of laths, and lower bainite which contains iron-based carbides having a major axis of 5 nm or more inside thereof. The iron-based carbides precipitated in the lower bainite belong to a single variant, that is, an iron-based carbide group extending in the same direction. The tempered martensite is an aggregation of lath-shaped crystal grains and contains iron-based carbides having a major axis of 5 nm or more inside thereof. The iron-based carbides in the tempered martensite belong to a plurality of variants, that is, a plurality of iron-based carbide groups extending in different directions. Further, in the embodiment, the martensite that is not tempered martensite is defined as a metallographic structure in which carbides having a diameter of 5 nm or more are not precipitated between the laths and inside the laths. Thus, at least three regions having a size of 40 μm×30 μm are observed at a sheet thickness ¼ depth position from the surface of the steel sheet at a magnification of 1000 to 100000 times using a scanning electron microscope, and based on whether or not the above-mentioned features are include, the proportions of the lower bainite and the upper bainite in the bainite and the proportions of the tempered martensite and the fresh martensite in the martensite are obtained to calculate the area ratio of each phase. Assuming that the area ratio is equal to the volume percentage, the area ratio is defined as the volume percentage.

The volume percentage of the retained austenite can be obtained by the X-ray diffraction. Since austenite has a different crystal structure from ferrite, the austenite can be easily crystallographically identified. For example, there is a method of easily obtaining the volume percentages of austenite and ferrite from a difference between the two in the reflection surface intensity by using Kα rays of Mo using the following expression.

$$V\gamma=(2/3)\{100/(0.7\times\alpha(211)/\gamma(220)+1)\}+(1/3)\{100/(0.78\times\alpha(211)/\gamma(311))+1)\}$$

However, α(211), γ(220), and γ(311) are the X-ray reflection surface intensities of ferrite (α) and austenite (γ), respectively.

In the hot-rolled steel sheet according to the embodiment, it is desirable that the iron-based carbides are contained in the tempered martensite and the lower bainite included in the microstructure at an average number density of $1.0\times10^6$ (carbides/mm$^2$) or more.

As-quenched martensite (fresh martensite) has excellent strength but has poor toughness. On the other hand, in the tempered martensite in which iron-based carbides such as cementite are precipitated, an excellent balance between strength and low temperature toughness can be obtained.

As a result of investigating the relationship between low temperature toughness and the number density of iron-based carbides, the present inventors have found that by setting the number density of carbides in the tempered martensite and the lower bainite to $1.0\times10^6$ (carbides/mm$^2$) or more, more excellent low temperature toughness can be secured. Therefore, it is preferable that the average number density of iron-based carbides contained in the tempered martensite and the lower bainite is set to $1.0\times10^6$ (carbides/mm$^2$) or more. The average number density is more preferably $5.0\times10^6$ (carbides/mm$^2$) or more and even more preferably $1.0\times10^7$ (carbides/mm$^2$) or more.

The size of the carbides precipitated in the hot-rolled steel sheet according to the embodiment obtained by the method described later is as small as 300 nm or less, and most of the carbides are precipitated in the lath of martensite or bainite. Therefore, it is presumed that the low temperature toughness is not deteriorated.

In measuring the number density of carbides, a sample is collected with the sheet thickness cross section parallel with the rolling direction of the steel sheet as a section to be observed, and the section to be observed is polished and nital-etched. Then, the range of ⅛ thickness to ⅜ thickness with a sheet thickness ¼ (t/4) position being the center is observed by a field emission scanning electron microscope (FE-SEM). 10 visual fields are each observed at a magnification of 200000 times to measure the number density of iron-based carbides contained in the tempered martensite and the lower bainite in the observed visual fields. The number density in each visual field is averaged and the obtained average value is set as the average number density.

In order to further improve the low temperature toughness, it is preferable that the primary phase is tempered martensite or lower bainite and the average effective grain size is 10 μm or less. The average effective grain size is more preferably 8 μm or less. The effective grain size described here means a region surrounded by grain boundaries having a crystal orientation difference of 15° or more described by the following method, and corresponds to a block grain size in the martensite and the bainite.

The effective grain size is obtained by visualizing the grains from an image mapped with an orientation difference of crystal grains defined as 15°, which is a threshold value of a high-angle grain boundary generally recognized as a grain boundary, using the electron back scatter diffraction pattern-orientation image microscope (EBSP-OIM™). The EBSP-OIM™ method is constituted by a device and a software that a highly inclined sample in a scanning electron microscope (SEM) is irradiated with electron beams, a Kikuchi pattern formed by backscattering is photographed by a high sensitive camera, and an image thereof is processed by a computer, thereby measuring a crystal orientation of an irradiation point for a short time period. In the EBSP method, it is possible to quantitatively analyze a microstructure and a crystal orientation of a bulk sample surface and an analysis area is a region which can be observed by the SEM. The EBSP method makes it possible to analyze a region with a minimum resolution of 20 nm, which varies depending on the resolution of the SEM.

It is desirable that the aspect ratio of the effective crystal grains (herein, each of which means a region surrounded by a grain boundary with 15° or more) of tempered martensite and bainite is set to 2.0 or less. Grains made flat in a specific direction have large anisotropy and a crack propagates along the grain boundary during a Charpy test, so that a toughness value often becomes low. Therefore, it is preferable that the effective crystal grains are grains that are equiaxial as much as possible. In the hot-rolled steel sheet according to the embodiment, the rolling direction cross section of the hot-rolled steel sheet is observed, and the ratio of the length of the effective crystal grain in the rolling direction (L) to the length in the sheet thickness direction (T) (=L/T) is defined as the aspect ratio.

Average Ni Concentration on Surface: 7.0% or More

In order to obtain excellent chemical convertibility and coating film adhesion in the zirconium-based chemical conversion film even on the surface of the ultrahigh-strength steel sheet after pickling (before a chemical conversion treatment), it is preferable that the amount of oxides of Si, Al, and the like on the surface of the pickled sheet is reduced to a harmless level. In order to obtain the above effect only by controlling the oxides of Si, Al, and the like, it is necessary to set a substantially non-oxidizing atmosphere using an inert gas such as Ar, He, or $N_2$ or to cause incomplete combustion with an air ratio of less than 0.9, in a preheating zone of a heating furnace to suppress oxidation of the slab surface as much as possible in a heating step of hot rolling. However, in a case where low cost and mass production are assumed in a step of manufacturing a general hot-rolled steel sheet, it is not possible to set a substantially non-oxidizing atmosphere using an inert gas in the heating step of hot rolling. In addition, even when the air ratio is set to less than 0.9 to control the oxides of Si, Al, and the like, heat loss due to incomplete combustion increases and the thermal efficiency of the heating furnace itself decreases to cause a problem such as an increase in manufacturing cost.

The present inventors have conducted an investigation on coating film adhesion after a chemical conversion treatment using a zirconium-based chemical conversion treatment liquid in the ultrahigh-strength steel sheet having the above-described chemical composition and structure, a tensile strength of 980 MPa or more, and toughness on the assumption of the application of a manufacturing step that is inexpensive and capable of mass production. Since the hot-rolled steel sheet is usually subjected to a chemical conversion treatment after pickling, the steel sheet after pickling is evaluated in the embodiment as well. Pickling is carried out using a 1 to 10 wt % (weight %) hydrochloric acid solution at a temperature of 20° C. to 95° C. under the condition of a pickling time of 30 seconds or more and less than 60 seconds. In a case where no scale is formed on the surface, evaluation may be performed without pickling.

As a result of the investigation, it has been found that in the measurement using FE-EPMA, in a case where the average Ni concentration on the surface is 7.0% or more in terms of mass %, even when the oxides of Si, Al, and the like remain on the surface of the pickled sheet, the coating peeling width in all the samples evaluated by the method described later is within 4.0 mm as a reference, and the coating film adhesion is excellent. In addition, in such a case, no lack of hiding is observed in the chemical conversion film. On the other hand, the coating peeling width is more than 4.0 mm in all the samples having an average Ni concentration of less than 7.0% on the surface.

Figure 2:
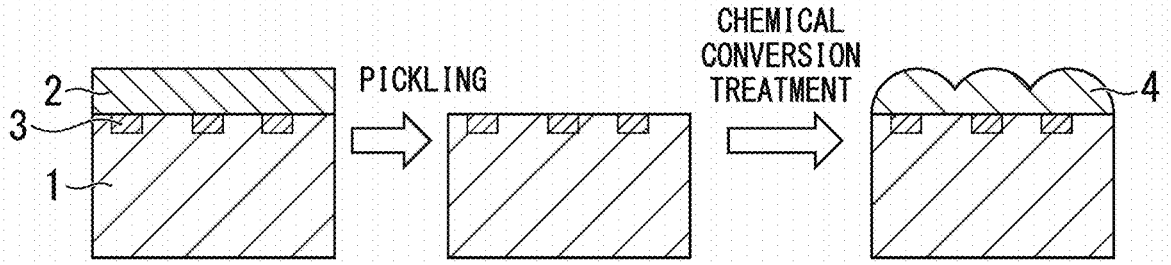
FIG. 2 is a diagram showing a mechanism in which Ni concentrated on the surface becomes a precipitation nucleus of a zirconium-based chemical conversion crystal.

It is considered that this is because, as shown in FIG. 2, by forming a Ni concentrated portion 3 on the surface of the steel sheet, a potential difference is generated between the locally concentrated Ni on the surface and a base metal 1, and this Ni becomes a precipitation nucleus of a zirconium-based chemical conversion crystal 4, so that the formation of the zirconium-based chemical conversion crystal 4 is promoted. The base metal 1 refers to the steel sheet portion excluding scale 2.

Therefore, in the hot-rolled steel sheet according to the embodiment, the average Ni concentration on the surface (the surface after pickling and before a chemical conversion treatment) is 7.0% or more. In a case where the average Ni concentration on the surface is 7.0% or more, even when the oxides of Si, Al, and the like remain on the surface, it is sufficient to form a precipitation nucleus of a zirconium-based chemical conversion crystal. In order to set the average Ni concentration on the surface to 7.0% or more, it is necessary to concentrate Ni, which is less likely to be oxidized than Fe on the base metal side of the interface between scale and the base metal by selectively oxidizing Fe to some extent on the surface of the steel sheet in the heating step of hot rolling.

The average Ni concentration on the surface of the steel sheet is measured using a JXA-8530F field emission electron probe microanalyzer (FE-EPMA). The measurement conditions are an acceleration voltage of 15 kV, an irradiation current of $6\times10^{-8}$ A, an irradiation time of 30 ms, and a beam diameter of 1 μm. The measurement is performed on a measurement area of 900 $\mu m^2$ or more from a direction perpendicular to the surface of the steel sheet, and the Ni concentration in the measurement range is averaged (the Ni concentration at all measurement points is averaged).

FIG. 1 shows an example of the EPMA measurement results of the surface.

Ni is mainly concentrated on the base metal side of the interface between scale and the base metal. In addition, pickling is usually performed before a chemical conversion treatment is performed. Therefore, in a case where scale is formed on the surface of the target steel sheet, the measurement is performed after pickling in the same manner as in a case where the steel sheet is subjected to a chemical conversion treatment.

The coating film adhesion of the pickled sheet described above is evaluated according to the following procedure. First, a manufactured steel sheet is pickled and then subjected to a chemical conversion treatment to attach a zirconium-based chemical conversion film. Further, electrodeposition coating with a thickness of 25 μm is performed on the upper surface thereof, and a coating baking treatment is performed at 170° C. for 20 minutes. Then, the electrodeposition coating film is cut to a length of 130 mm using a knife having a sharp tip end so that the cut portion reaches the base metal. Then, 5% salt water is continuously sprayed at a temperature of 35° C. for 700 hours under the salt spray conditions shown in JIS Z 2371: 2015, and then a tape having a width of 24 mm (NICHIBAN 405A-24, JIS Z 1522: 2009) is attached in parallel with the cut portion with a length of 130 mm and peeled off. Then, the maximum coating film peeling width is measured.

The hot-rolled steel sheet has an internal oxide layer (a region in which oxides are formed inside the base metal), and the average depth of the internal oxide layer from the surface of the hot-rolled steel sheet is 5.0 μm or more and 20.0 μm or less.

Even in a case where there is a Ni concentrated portion on the surface, when the coverage of oxides of Si, Al, and the like is too large on the surface of the hot-rolled steel sheet, "lack of hiding" on which the zirconium-based chemical conversion film is not attached are likely to be generated. In order to suppress this phenomenon, it is desirable that the oxidation of Si, Al, and the like is carried out by not external oxidation for forming oxides on the outer side of the base metal but internal oxidation for forming oxides on the inner side of the base metal.

The present inventors have observed the cross section of only a sample having an average Ni concentration of 7.0% or more on the surface with an optical microscope and have examined the relationship between the coating peeling width and the average depth of the internal oxide layers from the surface of the steel sheet (the average of the positions of the lower ends of the internal oxide layers). As a result, it has been found that while all the samples in which the average depth of the internal oxide layer is 5.0 μm or more have a coating peeling width of 3.5 mm or less, all the samples in which the average depth of the internal oxide layer is less than 5.0 μm have a coating peeling width of more than 3.5 mm and 4.0 mm or less.

Therefore, in a case of obtaining more excellent coating film adhesion, the average depth of the internal oxide layer from the surface of the hot-rolled steel sheet is preferably 5.0 μm or more and 20.0 μm or less.

When the average depth of the internal oxide layer of Si, Al, or the like is less than 5.0 μm, the internal oxidation is insufficient and the effect of suppressing "lack of hiding" on which the zirconium-based chemical conversion film is not attached is small. On the other hand, when the average depth is more than 20.0 μm, there is a concern that not only the effect of suppressing "lack of hiding" on which the zirconium-based chemical conversion film may be not attached is saturated, but also the hardness of the surface layer may be decreased due to the formation of a decarburized layer that occurs at the same time as internal oxidation, resulting in deterioration in fatigue durability.

The average depth of the internal oxide layer is obtained by cutting out a surface parallel with the rolling direction and the sheet thickness direction as an embedding sample at a ¼ or ¾ position in the sheet width direction of the pickled sheet, mirror-polishing the surface after embedding the steel sheet in the resin sample, and observing 12 or more visual fields with an optical microscope in a visual field of 195 μm×240 μm (corresponding to a magnification of 400 times) without etching. A position that intersects the surface of the steel sheet in a case where a straight line is drawn in the sheet thickness direction is set to a surface, the depth (position of the lower end) of the internal oxide layer in each visual field with the surface as a reference is measured and averaged at 5 points per visual field, the average value is calculated while excluding the maximum value and the minimum value from the average values of each visual field, and this calculated value is used as the average depth of the internal oxide layer.

Standard Deviation of Arithmetic Average Roughness Ra of Surface of Hot-Rolled Steel Sheet after Pickling Under Predetermined Conditions: 10.0 μm or More and 50.0 μm or Less The zirconium-based chemical conversion film has a very thin film thickness of about several tens of nm as compared with the conventional zinc phosphate film having a film thickness of several μm. This difference in film thickness is due to the fact that the zirconium-based chemical conversion crystals are extremely fine. When the chemical conversion crystal is fine, the surface of the chemical conversion crystal is very smooth. Thus, it is difficult to obtain a strong adhesion to the coating film due to the anchor effect as seen in the zinc phosphate-treated film.

However, as a result of the investigation by the present inventors, it has been found that the adhesion between the chemical conversion film and the coating film can be improved by forming irregularities on the surface of the steel sheet.

Based on the finding, regarding samples having an average Ni concentration of 7.0% or more and an internal oxide layer having an average depth of 5.0 μm or more, the present inventors have examined the relationship between the standard deviation of the arithmetic average roughness Ra of the surface of the pickled sheet before the zirconium-based chemical conversion treatment is performed and the coating film adhesion. As a result, while all the samples in which the standard deviation of the arithmetic average roughness Ra of the surface of the pickled sheet is 10.0 μm or more and 50.0 μm or less have a coating peeling width of 3.0 mm or less, all the samples in which the standard deviation of the arithmetic average roughness Ra of the surface of the pickled sheet is less than 10.0 μm or more than 50.0 μm have a coating peeling width of more than 3.0 mm and 3.5 mm or less.

Therefore, it is preferable that the standard deviation of the arithmetic average roughness Ra of the surface of the steel sheet after pickling is 10.0 μm or more and 50.0 μm or less.

When the standard deviation of the arithmetic average roughness Ra of the steel sheet surface is less than 10.0 μm, a sufficient anchor effect cannot be obtained. On the other hand, when the standard deviation of the arithmetic average roughness Ra of the steel sheet surface after pickling is more than 50.0 μm, not only the anchor effect is saturated, but also the zirconium-based chemical conversion crystals are less likely to be attached to the side surfaces of the valleys and mountain portions of the irregularities of the steel sheet surface after pickling. Thus, "lack of hiding" are more likely to be generated.

The surface roughness of the steel sheet greatly varies depending on the pickling conditions, but it is preferable that after the hot-rolled steel sheet according to the embodiment is pickled using a 1 to 10 wt % hydrochloric acid solution at a temperature of 20° C. to 95° C. under the condition of a pickling time of 30 seconds or more and less than 60 seconds, the standard deviation of the arithmetic average roughness Ra of the surface of the hot-rolled steel sheet is 10.0 μm or more and 50.0 μm or less.

For the standard deviation of the arithmetic average roughness Ra, a value obtained by measuring the surface roughness of the pickled sheet by the measurement method described in JIS B 0601: 2013 is adopted. After measuring the arithmetic average roughness Ra of the front and back surfaces of each of 12 or more samples, the standard deviation of the arithmetic average roughness Ra of each sample is calculated, and the maximum value and the minimum value are excluded from the standard deviations to calculate an average value.

The hot-rolled steel sheet according to the embodiment having the above-described chemical composition and metallographic structure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. The plating adhesion amount is not particularly limited and may be the same as before. Further, it is also possible to further enhance the corrosion resistance by applying an appropriate chemical conversion treatment (for example, application and drying of a silicate-based chromium-free chemical conversion treatment liquid) after plating.

[Method for Manufacturing Method Steel Sheet]

The hot-rolled steel sheet according to the embodiment can obtained the effects as long as the hot-rolled steel sheet has the above-mentioned features regardless of the manufacturing method. However, according to the manufacturing method shown below, the hot-rolled steel sheet can be stably manufactured and thus this method is preferable.

[Slab Manufacturing Step (Casting Step)]

A slab manufacturing step such as casting that is performed before hot rolling is not particularly limited. That is, subsequently to melting by a blast furnace, an electric furnace, or the like, it is only necessary to variously perform secondary refining, thereby performing adjustment so as to have the above-described components and then to perform casting by normal continuous casting, or by an ingot method, or further by thin slab casting, or the like.

In a case of continuous casting, a cast slab may be once cooled to low temperature and thereafter may be reheated to then be subjected to hot rolling. An ingot may be subjected to hot rolling without cooling to room temperature. Alternatively, a cast slab may be subjected to hot rolling continuously. A scrap may also be used for a raw material.

[Heating Step]

[Hot Rolling Step]

In the manufacturing of the hot-rolled steel sheet according to the embodiment, it is preferable that hot rolling is performed by heating a cast slab (steel piece) having a predetermined chemical composition to 1100° C. or higher using a heating furnace having three zones of a preheating zone, a heating zone, and a soaking zone and the hot rolling is completed at 850° C. or higher.

The slab heating temperature for the hot rolling is 1100° C. or higher. When the slab heating temperature is lower than 1100° C., in the subsequent hot rolling, the rolling reaction force increases and sufficient hot rolling cannot be performed. In this case, not only the desired product thickness cannot be obtained, but also the sheet shape is deteriorated, which may make it impossible to coil the product. In addition, the austenite grain size may become smaller, the hardenability may be decreased, and thus the desired microstructure may not be obtained. In a case where an element forming a carbonitride is contained in the steel such as Ti, it is preferable to heat the steel to a temperature higher than the solutionizing temperature in austenite.

On the other hand, although the effect can be obtained without particularly setting the upper limit of the slab heating temperature, it is not economically preferable to make the heating temperature excessively high. Thus, it is desirable that the upper limit of the slab heating temperature is lower than 1300° C.

The finish rolling temperature is preferably 850° C. or higher. When finish rolling is performed in a temperature range of lower than 850° C., the hardenability of the hot-rolled steel sheet according to the embodiment is decreased and a microstructure containing one or both of the target tempered martensite and lower bainite at a total volume percentage of 90% or more cannot be obtained. Therefore, the finish rolling temperature is 850° C. or higher.

In order to obtain excellent coating film adhesion, it is important to control the air ratio of each zone of the heating furnace in the slab heating. In order to control the air ratio in each zone, it is preferable that the burner equipment of the heating furnace is a regenerative-type burner. This is because in a case where "alternate combustion" is performed using a "regenerative burner" equipped with a burner having a built-in heat storage body, since the soaking properties of the temperature inside the furnace are high, the controllability of each zone is high, and particularly, the air ratio in each zone can be strictly controlled in the regenerative-type burner compared to the conventional burner that does not recover heat from the exhaust, the heating furnace described later can be controlled.

The preferable air ratio of each zone will be described.

<Air Ratio in Preheating Zone: 1.1 or More and 1.9 or Less>

By setting the air ratio in the preheating zone to 1.1 or more, Ni can be concentrated on the surface of the hot-rolled steel sheet, and the average Ni concentration on the surface of the hot-rolled steel sheet after pickling can be set to 7.0% or more.

The scale growth behavior of the slab surface in the heating furnace is classified into a linear rate law in which oxygen supply rate from the atmosphere on the slab surface is rate-controlling, and a parabolic rate law in which iron ion diffusion rate in the scale is rate-controlling based on the air ratio (oxygen partial pressure) when evaluated by the generated scale thickness. In order to promote the growth of the scale of the slab to some extent and form a sufficient Ni concentrated layer on the surface layer in the limited in-furnace time in the heating furnace, the growth of the scale thickness needs to follow the parabolic rate law.

When the air ratio in the preheating zone is less than 1.1, the scale growth does not follow the parabolic rate law and a sufficient Ni concentrated layer cannot be formed on the surface of the slab in the limited in-furnace time in the heating furnace. In this case, the average Ni concentration on the surface of the hot-rolled steel sheet after pickling is not 7.0% or more, and as a result, good coating film adhesion cannot be obtained.

On the other hand, when the air ratio in the preheating zone is more than 1.9, the scale-off amount increases and the yield is deteriorated, and the heat loss due to an increase in exhaust gas also increases. Thus, the thermal efficiency is deteriorated and the manufacturing cost is increased.

The amount of scale formed in the heating furnace is dominated by the atmosphere of the preheating zone immediately after insertion of the heating furnace, and even when the atmosphere of the subsequent zone is changed, the scale thickness is hardly affected. Accordingly, it is very important to control the scale growth behavior in the preheating zone.

<Air Ratio in Heating Zone: 0.9 or More and 1.3 or Less>

In order to form the internal oxide layer, it is necessary to control the air ratio in the heating zone in the heating step. By setting the air ratio in the heating zone to 0.9 or more and 1.3 or less, the average depth of the internal oxide layer can be set to 5.0 to 20.0 μm.

When the air ratio in the heating zone is less than 0.9, the average depth of the internal oxide layer is not 5.0 μm or more. On the other hand, when the air ratio in the heating zone is more than 1.3, there is a concern that not only the average depth of the internal oxide layer may be more than 20.0 μm, but also the hardness of the surface layer may be decreased due to the formation of a decarburized layer, resulting in deterioration in fatigue durability.

<Air Ratio in Soaking Zone: 0.9 or More and 1.9 or Less>

Figure 3:
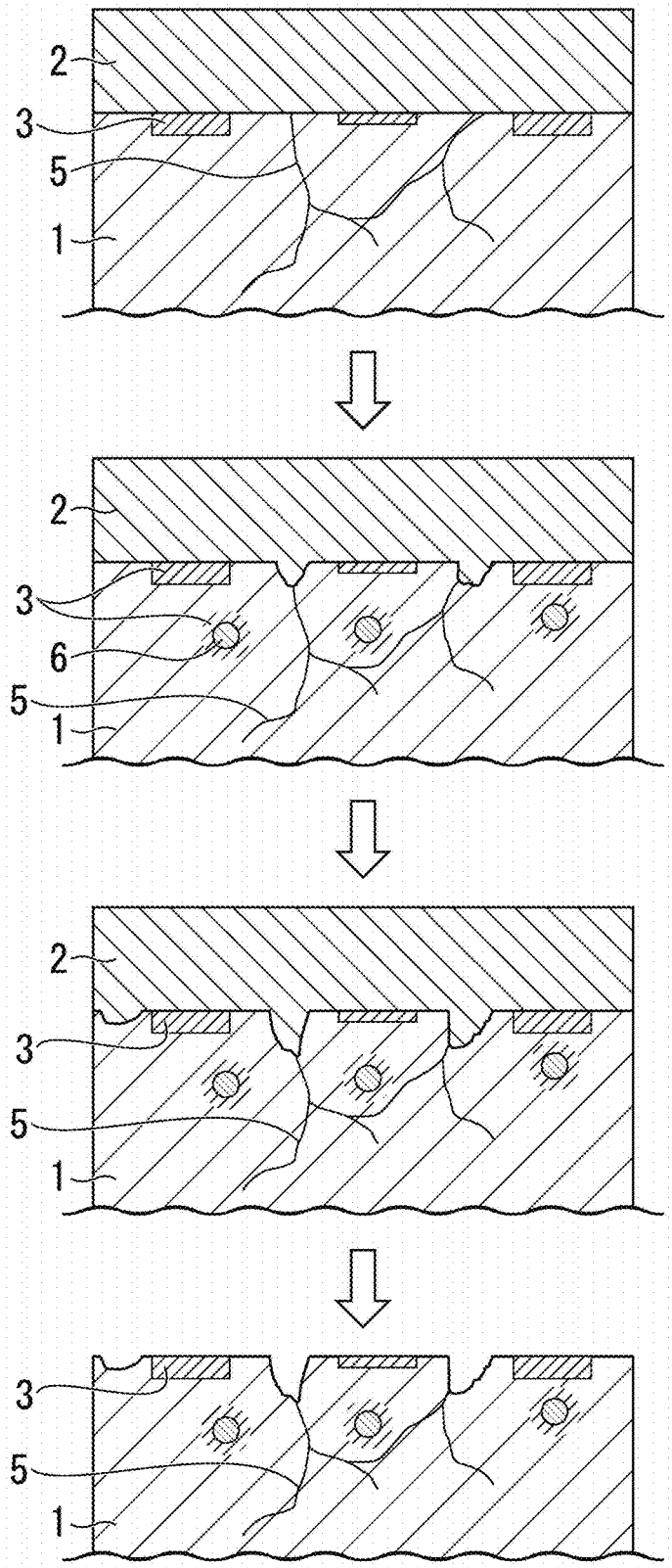
FIG. 3 is a diagram showing a mechanism in which the surface roughness of the hot-rolled steel sheet is changed.

In order to control the irregularities of the surface of the steel sheet after pickling, it is effective to control the air ratio in the soaking zone which is a zone immediately before extraction in the heating step. In the preheating zone, Ni, which is less likely to be oxidized than Fe, is concentrated on the base metal side at the interface between the scale and the base metal. While oxidation in the surface layer is suppressed by the Ni concentrated layer having the Ni concentrated portion, external oxidation is suppressed in the subsequent heating zone and internal oxidation is promoted. Thereafter, by controlling the air ratio in the soaking zone, for example, as shown in FIG. 3, grain boundaries 5 and the like where diffusion is easy are eroded by the scale 2, or the way of oxidation of the interface between the scale 2 and the base metal 1 due to a difference in the Ni concentration on the surface of the base metal 1 caused by a difference in the degree of Ni concentration degree becomes ununiform. Thus, the irregularities at the interface between the scale 2 and the base metal 1 become larger. In addition, although not shown in FIG. 3, irregularities are also generated by suppressing the erosion of the grain boundaries due to the scale 2 by the Ni concentrated portion 3 around an internal oxide 6. When this steel sheet is pickled, the scale 2 is removed, and the surface of the hot-rolled steel sheet has a predetermined roughness.

By setting the air ratio in the soaking zone to 0.9 or more and 1.9 or less, after the hot rolling, for example, pickling is performed using a 1 to 10 wt % hydrochloric acid solution at a temperature of 20° C. to 95° C. under the condition of a pickling time of 30 seconds or more and less than 60 seconds, the standard deviation of the arithmetic average roughness Ra of the surface of the hot-rolled steel sheet can be set to 10.0 μm or more and 50.0 μm or less.

When the air ratio in the soaking zone is less than 0.9, the oxygen potential for selectively forming oxide nuclei at the grain boundaries where diffusion is easy is not attained. Therefore, the standard deviation of the arithmetic average roughness Ra of the surface of the steel sheet after the pickling is not 10.0 μm or more. On the other hand, when the air ratio in the soaking zone is more than 1.9, the depth of the selectively oxidized grain boundaries in the sheet thickness direction becomes too deep, and the standard deviation of the arithmetic average roughness Ra of the steel sheet surface after the pickling is more than 50.0

Air Ratio in Preheating Zone>Air Ratio in Heating Zone

It is important to control the air ratio in the preheating zone to control the Ni concentration on the surface of the hot-rolled steel sheet after the pickling. On the other hand, it is important to control the air ratio in the heating zone to control the degree of formation of the internal oxide layer. Therefore, it is necessary to promote the growth of the scale of the slab to some extent in the preheating zone in the limited in-furnace time to form a sufficient Ni concentrated layer on the surface layer. For that purpose, a relatively high air ratio is required in which the growth of the scale thickness follows the parabolic rate law. On the other hand, in order to control the average depth of the internal oxide layer within a preferable range, it is necessary to suppress the air ratio to be relatively low in the heating zone and suppress the rapid growth of the internal oxide layer. In addition, when the air ratio is high in the heating zone, there is a concern that a decarburized layer may be formed and grown, the hardness of the surface layer may be decreased, and thus the fatigue durability may be deteriorated. Therefore, it is preferable that the air ratio in the preheating zone is higher than the air ratio in the heating zone.

[Cooling Step]

Average cooling rate from finish rolling temperature to Ms point temperature: 50° C./sec or higher and Maximum cooling rate at temperature lower than Ms point temperature: lower than 50° C./sec In the cooling step, cooling is performed to a temperature range equal to or lower than the Ms point temperature so that the average cooling rate from the finish rolling temperature to the Ms point temperature is 50° C./sec or higher (primary cooling). When the average cooling rate to the Ms point temperature is lower than 50° C./sec, ferrite and upper bainite are formed during cooling, and it is difficult to set the total volume percentage of tempered martensite and lower bainite as the primary phases to 90% or more. However, in a case where ferrite is not formed during the cooling process, air cooling may be performed in the middle of the temperature range. In a case where air cooling is performed in the cooling step, it is desirable that the temperature range is set to be lower than the lower bainite formation temperature. When the temperature at which air cooling is performed is equal to or higher than the lower bainite formation temperature, upper bainite is formed. In addition, it is preferable that the cooling rate until the temperature range in which air cooling is performed is set to 50° C./sec or higher. This is to avoid the formation of upper bainite. When the cooling rate between the Bs point temperature and the formation temperature of the lower bainite is lower than 50° C./sec, upper bainite may be formed and fresh martensite may be formed between the laths of the bainite. Alternatively, retained austenite (which becomes martensite with a high dislocation density during working) may be present, and low temperature toughness may be decreased. The Bs point temperature is the formation start temperature of the upper bainite determined by the components and is 550° C. for convenience. In addition, the formation temperature of the lower bainite is also determined by the components and is 400° C. for convenience. That is, with respect of the range between the finish rolling temperature and 400° C., it is preferable that the cooling rate is set to 50° C./sec or higher, particularly between 550° C. and 400° C., and the average cooling rate between the finish rolling temperature and 400° C. is set to 50° C./sec or higher.

It is preferable that cooling (secondary cooling) is performed by setting the maximum cooling rate in a temperature range from the primary cooling stop temperature to the temperature range of lower than 350° C. to lower than 50° C./sec after the above primary cooling is stopped in a temperature range of lower than the Ms point temperature and 350° C. or higher. This is to control the average number density of iron-based carbides in the tempered martensite or the lower bainite to be in a preferable range. When the maximum cooling rate in this temperature range is 50° C./sec or higher, it is difficult to set the average number density of the iron-based carbides in a preferable range. For this reason, it is preferable that the maximum cooling rate is lower than 50° C./sec.

Here, cooling at a maximum cooling rate of lower than 50° C./sec in a temperature range of lower than the Ms point temperature to lower than 350° C. can be realized by, for example, air cooling. In addition, the cooling not only includes cooling, but also includes isothermal holding and the like. Further, since the purpose of the cooling rate control in this temperature range is to control the number density of iron-based carbides in the steel sheet structure, cooling may be once performed to the martensitic transformation end temperature (Mf point) or lower obtained by Expression (5) and then the temperature may be raised to perform reheating.

$$Mf=0.285\times Ms-460\times C+232 \quad (5)$$

[Coiling Step]

Coiling Temperature: Lower than 350° C.

Generally, in order to obtain martensite, it is necessary to suppress the ferritic transformation, and the cooling at 50° C./sec or higher is required. In addition, at low temperatures, a temperature zone transits from a temperature range whose heat transfer coefficient is relatively low and in which it is not easily cooled, called a film boiling region to a temperature range whose heat transfer coefficient is large and where it is easily cooled, called a nucleate boiling temperature region. In a case where a temperature range of lower than 400° C. is set to a cooling stop temperature, the coiling temperature fluctuates easily, and with the fluctuation, the quality of material also changes. Therefore, there is often a case where the normal coiling temperature is set to be higher than 400° C. or coiling is performed at room temperature.

As a result, it is assumed that it is conventionally difficult to find that a tensile strength of 980 MPa or more and excellent low temperature toughness can be secured simultaneously by the coiling and a decrease in the cooling rate at a temperature of lower than 400° C.

In the hot-rolled steel sheet according to the embodiment, by performing cooling as described above, a tensile strength of 980 MPa or more and excellent low temperature toughness can be secured simultaneously even when coiling is performed at a temperature of lower than 350° C.

After coiling, shape correction may be performed by skin pass rolling or a strain removing heat treatment may be performed at less than 400° C. as necessary.

[Pickling Step]

[Skin Pass Step]

Skin pass rolling may be performed at a rolling reduction of 0.1% or more and 2.0% or less for the purpose of correcting the steel sheet shape and improving the ductility by introduction of moving dislocation. In addition, for the purpose of removing scale attached to the surface of the obtained hot-rolled steel sheet, pickling may be performed on the obtained hot-rolled steel sheet. In a case where pickling is performed, it is preferable to perform pickling using a 1 to 10 wt % hydrochloric acid solution at a temperature of 20° C. to 95° C. under the condition of a pickling time of 30 seconds or more and less than 60 seconds.

Further, it is also possible to perform skin pass or cold rolling at a rolling reduction of 10% or less inline or offline on the obtained hot-rolled steel sheet after the pickling.

The hot-rolled steel sheet according to the embodiment is manufactured through continuous casting, rough rolling, finish rolling, cooling, coiling, and pickling, which are the normal hot-rolling step. However even when the hot-rolled steel sheet is manufactured by omitting some of these processes, it is possible to secure a tensile strength of 980 MPa or more and excellent low temperature toughness. In addition, eve when a heat treatment is performed in a temperature range of 100° C. to 600° C. online or offline for the purpose of precipitation of carbides after the hot-rolled steel sheet is once manufactured, it is possible to secure excellent low temperature toughness and a tensile strength of 980 MPa or more.

In the embodiment, the steel sheet having a tensile strength of 980 MPa or more means a steel sheet whose tensile strength measured by a tensile test performed according to JIS Z 2241: 2011 by using a JIS No. 5 test piece cut out in a direction perpendicular to the rolling direction of hot rolling is 980 MPa or more.

In the embodiment, the steel sheet having excellent toughness at low temperature refers to a steel sheet having a fracture appearance transition temperature (vTrs) of −40° C. or lower in the Charpy test performed according to JIS Z 2242: 2005. In a case where the target steel sheet is mainly used for vehicle applications, the sheet thickness is about 0.8 to 8.0 mm, but in many cases, the sheet thickness is about 3.0 mm. Therefore, in the embodiment, the surface of the hot-rolled steel sheet is ground and the steel sheet is worked into a 2.5 mm subsize test piece.

According to the above manufacturing method, the hot-rolled steel sheet according to the embodiment can be obtained. The hot-rolled steel sheet according to the embodiment is an ultrahigh-strength steel sheet having a tensile strength of 980 MPa or more, and even in a case where a zirconium-based chemical conversion treatment liquid is used, chemical convertibility and coating film adhesion equal to or higher than those in a case where a zinc phosphate chemical conversion treatment liquid is used can be obtained. Therefore, the hot-rolled steel sheet according to the embodiment is suitable for a component for a vehicle that requires high strength and corrosion resistance after coating.

Examples

Hereinafter, the present invention will be described in more detail with reference to examples, but the present invention is not limited to these examples.

Steels having the chemical compositions shown in Steel Nos. A to V in Tables 1A and 1B (where Table B1 is continuous to Table 1A) were melted and subjected to continuous casting to manufacture slabs having a thickness of 240 to 300 mm. The obtained slabs were heated to the temperatures shown in Tables 2A and 2B using a regenerative-type burner. At that time, the air ratios in the preheating zone, the heating zone, and the soaking zone were controlled as shown in Tables 2A and 2B.

The heated slabs were hot-rolled at the finish temperatures shown in Tables 2A and 2B. After the hot rolling, cooling was performed under the cooling conditions shown in Tables 2A and 2B, and after the cooling, coiling was performed.

The microstructures of the obtained hot-rolled steel sheets of Manufacturing Nos 1 to 35 were observed, and the volume percentage of each phase and the average effective grain size were obtained.

The volume percentage of each phase was obtained by the following method.

First, the sample was subjected to Nital etching, and the structure photograph obtained in a visual field of 300 μm×300 μm using an optical microscope after the etching was subjected to image analysis to obtain the area ratio of each of ferrite and pearlite and the total area ratio of bainite, martensite, and retained austenite. Next, the portion subjected to Nital etching was subjected to Lepera etching, and the structure photograph obtained in a visual field of 300 μm×300 μm using an optical microscope was subjected to image analysis to calculate a total area ratio of the retained austenite and the martensite. Further, the retained austenite area ratio was obtained by X-ray diffraction measurement using a sample whose surface was cut to a depth of ¼ of the sheet thickness from the direction normal to the rolled surface, and the area ratios of ferrite, bainite, martensite retained austenite, and pearlite were obtained respectively. Thereafter, at least three regions having a size of 40 μm×30 μm at a sheet thickness ¼ depth position from the surface of the steel sheet were observed at a magnification of 1000 to 100000 times using a scanning electron microscope, and based on whether or not the above-mentioned properties were included, the proportions of the lower bainite and the upper bainite in the bainite and the proportions of the tempered martensite and the fresh martensite in the martensite were obtained. From the obtained values, the area ratio of each phase was calculated and used as the volume percentage.

The average effective grain size was obtained by visualizing the grains from an image mapped with an orientation difference of crystal grains defined as 15°, which is a threshold value of a high-angle grain boundary generally recognized as a grain boundary, at a sheet thickness ¼ depth position from the surface of the steel sheet using the electron back scatter diffraction pattern-orientation image microscope (EBSP-OIM™). In addition, the aspect ratio was also measured.

The Ni concentration on the surface was obtained by the following method.

The Ni concentration in the target hot-rolled steel sheet was analyzed in a measurement area of 900 $\mu m^2$ or more from a direction perpendicular the surface of the steel sheet using a JXA-8530F field emission electron probe microanalyzer (PE-EPMA), and the Ni concentrations in the measurement range were averaged. At this time, the measurement conditions were an acceleration voltage of 15 kV, an irradiation current of $6\times10^{-8}$ A, an irradiation time of 30 ms, and a beam diameter of 1 μm.

The number density of iron-based carbides was obtained by the following method.

A sample was collected with the cross section parallel to the rolling direction of the steel sheet as the section to be observed, and the section to be observed was polished and nital-etched. Then, 10 visual fields of a range of ⅛ thickness to ⅜ thickness with a sheet thickness ¼ depth position from the surface of the steel sheet being the center were observed using a field emission scanning electron microscope (FE-SEM) at a magnification of 200000 times. The number density of the iron-based carbides was measured.

The average depth of the internal oxide layer was obtained by the following method.

A surface parallel with the rolling direction and the sheet thickness direction was cut out as an embedding sample at a ¼ or ¾ position in the sheet width direction of the pickled sheet, the surface was mirror-polished after embedding the steel sheet in the resin sample, and 12 visual fields were observed with an optical microscope in a visual field of 195 μm×240 μm (corresponding to a magnification of 400 times) without etching. A position intersecting the surface of the steel sheet in a case where a straight line was drawn in the sheet thickness direction was set to a surface, the depth (position of the lower end) of the internal oxide layer in each visual field with the surface as a reference was measured and averaged at 5 points per visual field, the average value was calculated while excluding the maximum value and the minimum value from the average values of each visual field, and this calculated value was used as the average depth of the internal oxide layer.

The standard deviation of the arithmetic average roughness of the surface was calculated by the following method.

The surface roughness of the pickled sheet was obtained by measuring the arithmetic average roughness Ra of the front and back surfaces of each of 12 samples by the measurement method described in JIS B 0601: 2013, then calculating the standard deviation of the arithmetic average roughness Ra of each sample, and excluding the maximum value and the minimum value from the standard deviations to calculate an average value.

In addition, the tensile strength and toughness (vTrs) of the obtained steel sheets of Manufacturing Nos. 1 to 35 were obtained as mechanical properties.

The tensile strength was obtained by performing a tensile test in accordance with JIS Z 2241 using a JIS No. 5 test piece cut out in a direction perpendicular to the rolling direction of hot rolling.

It was determined that preferable properties were obtained when the tensile strength was 980 MPa or more.

The toughness was obtained by grinding the surface of the hot-rolled steel sheet, working the steel sheet into a 2.5 mm subsize test piece, and performing the Charpy test according to JIS Z 2242 to obtain the fracture appearance transition temperature (vTrs).

When vTrs was −40° C. or lower, it was determined that preferable properties were obtained.

The chemical convertibility was evaluated by the following method.

The surface of the steel sheet after the chemical conversion treatment was observed with a field emission scanning electron microscope (FE-SEM). Specifically, 10 visual fields were observed at a magnification of 10000 times, and the presence or absence of "lack of hiding" on which the chemical conversion crystals were not attached was observed. The observation was performed at an acceleration voltage of 5 kV, a probe diameter of 30 mm, and inclination angles of 45° and 60°. Tungsten coating (ESC-101, Elionix Co., Ltd.) was applied for 150 seconds to impart conductivity to the sample.

In a case where no lack of hiding was observed in all the visual fields, it was determined that the chemical convertibility was excellent ("OK" in the tables).

The coating film adhesion was evaluated by the following method.

Electrodeposition coating with a thickness of 25 μm was performed to on upper surface of the hot-rolled steel sheet after the chemical conversion treatment, and a coating baking treatment was performed at 170° C. for 20 minutes. Then, the electrodeposition coating film was cut to a length of 130 mm using a knife having a sharp tip end so that the cut portion reached the base metal. Then, 5% salt water was continuously sprayed at a temperature of 35° C. for 700 hours under the salt spray conditions shown in JIS Z 2371, and then a tape having a width of 24 mm (NICHIBAN 405A-24, JIS Z 1522) was attached in parallel with the cut portion with a length of 130 mm and peeled off. Then, the maximum coating film peeling width was measured.

When the maximum coating film peeling width was 4.0 mm or less, it was determined that the coating film adhesion was excellent.

The results are shown in Tables 3A and 3B.

As seen from Tables 3A and 3B, in Manufacturing Nos. 1 to 3, 7 to 10, 14, and 17 to 28 as Invention Examples, chemical convertibility films having excellent toughness even when the tensile strength was 980 MPa, good chemical convertibility even when the chemical convertibility using a zirconium-based chemical conversion treatment liquid was performed, and excellent coating film adhesion were obtained.

On the other hand, in Manufacturing Nos. 4 to 6, 11 to 13, 15, 16, and 29 to 35 in which the component, the metallographic structure, or the Ni concentration on the surface was not in the range of the present invention, the mechanical properties were not sufficient, the chemical convertibility and/or the coating film adhesion were deteriorated.

TABLE 1A

| Steel | Mass % Remainder of Fe and impurities | | | | | | | | | | | | | | |
|---|---|---|---|---|---|---|---|---|---|---|---|---|---|---|---|
| No. | C | Si | Mn | Al | P | S | O | N | Ni | Nb | Ti | Cu | Mo | V | Cr |
| A | 0.109 | 0.23 | 2.17 | 0.024 | 0.007 | 0.0090 | 0.0018 | 0.0021 | 0.02 | | | | | | |
| B | 0.068 | 0.99 | 1.92 | 0.027 | 0.012 | 0.0030 | 0.0019 | 0.0046 | 0.49 | | | | | | |
| C | 0.083 | 0.05 | 2.65 | 0.020 | 0.010 | 0.0020 | 0.0020 | 0.0029 | 0.03 | | | | | | |
| D | 0.198 | 1.00 | 1.89 | 0.032 | 0.001 | 0.0040 | 0.0012 | 0.0009 | 0.05 | | | | | | |

TABLE 1A-continued

| Steel | Mass % Remainder of Fe and impurities | | | | | | | | | | | | | | |
|---|---|---|---|---|---|---|---|---|---|---|---|---|---|---|---|
| No. | C | Si | Mn | Al | P | S | O | N | Ni | Nb | Ti | Cu | Mo | V | Cr |
| E | 0.063 | 0.07 | 3.88 | 0.032 | 0.005 | 0.0070 | 0.0014 | 0.0022 | 0.06 | | | | | | |
| F | 0.109 | 1.06 | 2.04 | 0.041 | 0.009 | 0.0090 | 0.0008 | 0.0006 | 0.22 | 0.029 | | | | | |
| G | 0.099 | 1.84 | 2.24 | 0.007 | 0.007 | 0.0080 | 0.0009 | 0.0016 | 0.24 | | 0.095 | | | | |
| H | 0.076 | 1.05 | 2.74 | 0.048 | 0.010 | 0.0050 | 0.0013 | 0.0031 | 0.41 | | | 0.04 | | | |
| I | 0.105 | 2.08 | 1.54 | 0.049 | 0.004 | 0.0080 | 0.0009 | 0.0046 | 0.09 | | | | 0.443 | | |
| J | 0.070 | 2.10 | 2.59 | 0.048 | 0.005 | 0.0080 | 0.0005 | 0.0011 | 0.06 | | | | | 0.029 | |
| K | 0.091 | 0.22 | 2.68 | 0.045 | 0.014 | 0.0040 | 0.0009 | 0.0020 | 0.13 | | | | | | 0.18 |
| L | 0.106 | 0.39 | 1.95 | 0.026 | 0.006 | 0.0030 | 0.0010 | 0.0023 | 0.32 | | | | | | |
| M | 0.073 | 1.81 | 1.67 | 0.014 | 0.004 | 0.0080 | 0.0009 | 0.0024 | 0.33 | | | | | | |
| N | 0.118 | 1.61 | 1.41 | 0.022 | 0.012 | 0.0070 | 0.0006 | 0.0008 | 0.07 | | | | | | |
| O | 0.066 | 0.05 | 2.24 | 0.021 | 0.009 | 0.0020 | 0.0014 | 0.0034 | 0.44 | | | | | | |
| P | 0.046 | 2.08 | 2.45 | 0.038 | 0.014 | 0.0010 | 0.0006 | 0.0019 | 0.19 | | | | | | |
| Q | 0.218 | 0.09 | 1.29 | 0.021 | 0.002 | 0.0050 | 0.0025 | 0.0049 | 0.02 | | | | | | |
| R | 0.072 | 0.81 | 2.26 | 0.033 | 0.003 | 0.0030 | 0.0020 | 0.0027 | 0.01 | | | | | | |
| S | 0.156 | 0.53 | 0.96 | 0.019 | 0.009 | 0.0090 | 0.0014 | 0.0014 | 0.17 | | | | | | |
| T | 0.069 | 2.30 | 2.22 | 0.611 | 0.012 | 0.0070 | 0.0021 | 0.0020 | 0.45 | | | | | | |
| U | 0.053 | 0.06 | 1.74 | 0.009 | 0.005 | 0.0090 | 0.0007 | 0.0011 | 0.41 | | | | | | |
| V | 0.199 | 0.12 | 3.87 | 0.028 | 0.006 | 0.0050 | 0.0014 | 0.0018 | 0.09 | | | | | | |

TABLE 1B

| Steel | Mass % Remainder of Fe and impurities | | | | | | | | | Si + Al | | Ms | Mf |
|---|---|---|---|---|---|---|---|---|---|---|---|---|---|
| No. | Mg | Ca | REM | B | Zr | Co | Zn | W | Sn | (%) | PCM | (° C.) | (° C.) |
| A | | | | | | | | | | 0.25 | 0.23 | 437 | 307 |
| B | | | | | 0.015 | | | | | 1.02 | 0.21 | 457 | 331 |
| C | | | | | | | | | | 0.07 | 0.22 | 434 | 317 |
| D | | | | | | | | | | 1.03 | 0.33 | 404 | 256 |
| E | | | | | | | | | | 0.10 | 0.26 | 402 | 318 |
| F | | | | | | 0.969 | | | | 1.10 | 0.25 | 438 | 307 |
| G | | | | | | | | | | 1.85 | 0.28 | 436 | 311 |
| H | | | | | | | | | | 1.10 | 0.26 | 428 | 319 |
| I | | | | | | | | | 0.006 | 2.13 | 0.28 | 450 | 312 |
| J | | | | | | | | | | 2.15 | 0.27 | 441 | 326 |
| K | | | | | | | 0.536 | | | 0.27 | 0.24 | 424 | 311 |
| L | 0.0008 | | | | | | | | | 0.42 | 0.22 | 441 | 309 |
| M | | 0.0012 | | | | | | | | 1.82 | 0.22 | 466 | 331 |
| N | | | 0.0014 | | | | | 0.66 | | 1.63 | 0.24 | 457 | 308 |
| O | | | | 0.0025 | | | | | | 0.07 | 0.20 | 448 | 329 |
| P | | | | | | | | | | 2.12 | 0.24 | 455 | 341 |
| Q | | | | | | | | | | 0.11 | 0.29 | 415 | 250 |
| R | | | | | | | | | | 0.84 | 0.21 | 452 | 328 |
| S | | | | | | | | | | 0.55 | 0.22 | 453 | 289 |
| T | | | | | | | | | | 2.91 | 0.26 | 447 | 328 |
| U | | | | | | | | | | 0.07 | 0.15 | 471 | 342 |
| V | | | | | | | | | | 0.15 | 0.40 | 337 | 237 |

TABLE 2A

| Manufacturing No. | Steel No. | Heating temperature ° C. | Preheating zone air ratio | Heating zone air ratio | Soaking zone air ratio | Finish rolling temperature ° C. | Primary cooling average cooling rate ° C./s | Ms ° C. | Primary cooling stop temperature ° C. | Secondary cooling maximum cooling rate ° C./s | Coiling temperature ° C. |
|---|---|---|---|---|---|---|---|---|---|---|---|
| 1 | A | 1210 | 1.8 | 0.9 | 1.0 | 900 | 60 | 437 | 390 | 30 | 310 |
| 2 | B | 1250 | 1.7 | 1.1 | 1.8 | 870 | 60 | 457 | 360 | 30 | 100 |
| 3 | C | 1220 | 1.8 | 1.1 | 1.1 | 900 | 50 | 434 | 400 | 40 | 280 |
| 4 | C | 1080 | 1.3 | 1.2 | 1.5 | 970 | 90 | 434 | 370 | 30 | 120 |
| 5 | C | 1210 | 2.0 | 1.2 | 1.4 | 890 | 80 | 434 | 400 | 20 | 270 |
| 6 | C | 1220 | 1.0 | 1.1 | 1.4 | 960 | 80 | 434 | 400 | 10 | 270 |
| 7 | C | 1230 | 1.4 | 1.4 | 1.4 | 970 | 80 | 434 | 370 | 40 | 280 |
| 8 | C | 1240 | 1.3 | 0.8 | 1.3 | 890 | 80 | 434 | 360 | 20 | 80 |
| 9 | C | 1200 | 1.6 | 1.3 | 2.0 | 940 | 80 | 434 | 380 | 20 | 50 |
| 10 | C | 1230 | 1.5 | 1.0 | 0.8 | 910 | 60 | 434 | 390 | 30 | 170 |
| 11 | C | 1250 | 1.4 | 1.3 | 1.1 | 830 | 70 | 434 | 380 | 50 | 260 |
| 12 | C | 1240 | 1.1 | 1.3 | 1.7 | 970 | 45 | 434 | 390 | 40 | 30 |

TABLE 2A-continued

| Manufacturing No. | Steel No. | Heating temperature ° C. | Preheating zone air ratio | Heating zone air ratio | Soaking zone air ratio | Finish rolling temperature ° C. | Primary cooling average cooling rate ° C./s | Ms ° C. | Primary cooling stop temperature ° C. | Secondary cooling maximum cooling rate ° C./s | Coiling temperature ° C. |
|---|---|---|---|---|---|---|---|---|---|---|---|
| 13 | C | 1210 | 1.3 | 1.0 | 1.8 | 960 | 60 | 434 | 450 | 20 | 10 |
| 14 | C | 1200 | 1.7 | 1.0 | 1.0 | 930 | 70 | 434 | 300 | 10 | 140 |
| 15 | C | 1220 | 1.5 | 1.1 | 1.8 | 990 | 90 | 434 | 350 | 70 | 60 |
| 16 | C | 1230 | 1.5 | 0.9 | 1.1 | 880 | 60 | 434 | 380 | 40 | 370 |
| 17 | D | 1220 | 1.7 | 1.1 | 1.4 | 870 | 60 | 404 | 360 | 40 | 110 |

TABLE 2B

| Manufacturing No. | Steel No. | Heating temperature ° C. | Preheating zone air ratio | Heating zone air ratio | Soaking zone air ratio | Finish rolling temperature ° C. | Primary cooling average cooling rate ° C./s | Ms ° C. | Primary cooling stop temperature ° C. | Secondary cooling maximum cooling rate ° C./s | Coiling temperature ° C. |
|---|---|---|---|---|---|---|---|---|---|---|---|
| 18 | E | 1130 | 1.5 | 1.0 | 1.7 | 900 | 50 | 402 | 380 | 20 | 160 |
| 19 | F | 1220 | 1.8 | 0.9 | 1.6 | 890 | 70 | 438 | 370 | 20 | 340 |
| 20 | G | 1210 | 1.4 | 1.0 | 1.4 | 850 | 60 | 436 | 400 | 10 | 140 |
| 21 | H | 1210 | 1.5 | 1.1 | 1.2 | 920 | 90 | 428 | 370 | 10 | 290 |
| 22 | I | 1230 | 1.4 | 1.2 | 1.1 | 860 | 60 | 450 | 370 | 30 | 160 |
| 23 | J | 1200 | 1.2 | 1.0 | 1.7 | 970 | 80 | 441 | 370 | 30 | 110 |
| 24 | K | 1200 | 1.8 | 1.2 | 1.8 | 860 | 50 | 424 | 360 | 10 | 340 |
| 25 | L | 1210 | 1.5 | 1.0 | 1.8 | 910 | 90 | 441 | 370 | 30 | 300 |
| 26 | M | 1230 | 1.9 | 0.9 | 1.1 | 1000 | 50 | 466 | 370 | 40 | 170 |
| 27 | N | 1230 | 1.5 | 1.1 | 1.4 | 950 | 90 | 457 | 360 | 40 | 300 |
| 28 | O | 1220 | 1.5 | 0.9 | 1.5 | 940 | 60 | 449 | 370 | 40 | 270 |
| 29 | P | 1230 | 1.6 | 1.2 | 1.2 | 950 | 60 | 455 | 380 | 40 | 60 |
| 30 | Q | 1250 | 1.8 | 1.0 | 1.8 | 900 | 80 | 415 | 370 | 40 | 20 |
| 31 | R | 1250 | 1.3 | 1.2 | 1.0 | 880 | 80 | 452 | 370 | 30 | 150 |
| 32 | S | 1220 | 1.1 | 0.9 | 1.8 | 890 | 80 | 453 | 360 | 10 | 240 |
| 33 | T | 1250 | 1.4 | 0.9 | 1.1 | 930 | 60 | 447 | 390 | 10 | 320 |
| 34 | U | 1210 | 1.2 | 1.2 | 1.2 | 910 | 100 | 471 | 380 | 20 | 270 |
| 35 | V | 1220 | 1.6 | 1.2 | 1.7 | 880 | 60 | 337 | 330 | 20 | 200 |

TABLE 3A

| Manufacturing No. | Metallographic structure: Volume % of tempered martensite and lower bainite | Metallographic structure: Volume % of others | Average effective grain size μm | Aspect ratio | Average number density of iron-based carbides ($\times 10^6$) carbides/mm$^2$ | Ni concentration on surface mass % |
|---|---|---|---|---|---|---|
| 1 | 96 | 4 | 7.2 | 1.8 | 9.0 | 9.7 |
| 2 | 93 | 7 | 7.1 | 1.9 | 9.0 | 9.0 |
| 3 | 96 | 4 | 9.1 | 1.8 | 6.0 | 9.5 |
| 4 | 88 | 12 | 11.1 | 1.3 | 0.8 | 6.6 |
| 5 | 95 | 5 | 9.7 | 1.8 | 7.0 | 6.5 |
| 6 | 95 | 5 | 9.1 | 1.4 | 10.0 | 2.0 |
| 7 | 96 | 4 | 9.0 | 1.3 | 2.0 | 9.5 |
| 8 | 93 | 7 | 7.4 | 1.8 | 2.0 | 7.4 |
| 9 | 93 | 7 | 8.1 | 1.5 | 6.0 | 8.1 |
| 10 | 94 | 6 | 7.3 | 1.7 | 3.0 | 8.3 |
| 11 | 75 | 25 | 11.8 | 2.3 | 0.9 | 9.8 |
| 12 | 70 | 30 | 12.2 | 1.3 | 0.4 | 9.0 |
| 13 | 77 | 23 | 11.1 | 1.4 | 0.8 | 8.9 |
| 14 | 90 | 10 | 8.2 | 1.6 | 0.5 | 8.0 |

TABLE 3A-continued

| | | | | | | |
|---|---|---|---|---|---|---|
| 15 | 85 | 15 | 11.2 | 1.2 | 0.2 | 7.3 |
| 16 | 88 | 12 | 11.5 | 1.9 | 0.1 | 8.6 |
| 17 | 94 | 6 | 8.0 | 1.9 | 4.0 | 7.6 |

| | | | Properties | | | | |
|---|---|---|---|---|---|---|---|
| Manufacturing No. | Average depth of internal oxide layer μm | Arithmetic average roughness of surface μm | Tensile strength MPa | Toughness (vTrs) ° C. | Chemical convertibility | Coating film adhesion (peeling width) mm | Remarks |
| 1 | 12.4 | 48.6 | 1161 | −60 | OK | 0.9 | Invention Example |
| 2 | 13.6 | 38.9 | 1046 | −70 | OK | 1.5 | Invention Example |
| 3 | 17.3 | 11.2 | 1119 | −65 | OK | 2.7 | Invention Example |
| 4 | 4.8 | 9.6 | 971 | −35 | NG | 6.4 | Comparative Example |
| 5 | 34.0 | 61.0 | 1157 | −45 | NG | 6.5 | Comparative Example |
| 6 | 4.0 | 7.0 | 1174 | −60 | NG | 6.3 | Comparative Example |
| 7 | 21.0 | 55.0 | 1140 | −65 | OK | 3.8 | Invention Example |
| 8 | 4.4 | 9.0 | 1062 | −50 | OK | 3.6 | Invention Example |
| 9 | 15.7 | 52.0 | 1032 | −60 | OK | 3.4 | Invention Example |
| 10 | 8.8 | 9.0 | 1118 | −55 | OK | 3.3 | Invention Example |
| 11 | 19.7 | 21.7 | 920 | −35 | OK | 0.4 | Comparative Example |
| 12 | 12.7 | 48.8 | 951 | −30 | OK | 0.4 | Comparative Example |
| 13 | 14.2 | 17.7 | 977 | −35 | OK | 0.5 | Comparative Example |
| 14 | 6.3 | 28.9 | 1006 | −45 | OK | 0.3 | Invention Example |
| 15 | 12.1 | 45.2 | 1223 | −30 | OK | 2.1 | Comparative Example |
| 16 | 5.0 | 16.7 | 1324 | −35 | OK | 2.1 | Comparative Example |
| 17 | 13.4 | 41.0 | 1445 | −45 | OK | 2.2 | Invention Example |

TABLE 3B

| | Metallographic structure | | | | | |
|---|---|---|---|---|---|---|
| Manufacturing No. | Volume % of tempered martensite and lower bainite | Volume % of others | Average effective grain size μm | Aspect ratio | Average number density of iron-based carbides ($\times 10^6$) carbides/mm$^2$ | Ni concentration on surface mass % |
| 18 | 94 | 6 | 7.6 | 1.8 | 4.0 | 9.7 |
| 19 | 96 | 4 | 9.3 | 1.8 | 5.0 | 9.4 |
| 20 | 94 | 6 | 9.4 | 1.9 | 4.0 | 7.6 |
| 21 | 96 | 4 | 7.6 | 1.6 | 1.0 | 8.7 |
| 22 | 94 | 6 | 9.9 | 1.9 | 6.0 | 8.9 |
| 23 | 94 | 6 | 8.9 | 1.3 | 8.0 | 7.0 |
| 24 | 96 | 4 | 8.0 | 1.9 | 9.0 | 9.9 |
| 25 | 96 | 4 | 9.0 | 1.7 | 3.0 | 8.4 |
| 26 | 94 | 6 | 8.2 | 1.1 | 8.0 | 7.6 |
| 27 | 96 | 4 | 6.3 | 1.4 | 9.0 | 8.1 |
| 28 | 95 | 5 | 8.8 | 1.5 | 7.0 | 7.7 |
| 29 | 88 | 12 | 11.9 | 1.4 | 0.9 | 8.5 |
| 30 | 93 | 7 | 12.1 | 1.8 | 11.0 | 8.5 |

TABLE 3B-continued

| | | | | | | |
|---|---|---|---|---|---|---|
| 31 | 94 | 6 | 8.1 | 1.9 | 9.0 | 7.2 |
| 32 | 88 | 12 | 8.8 | 1.8 | 6.0 | 8.6 |
| 33 | 96 | 4 | 9.3 | 1.6 | 5.0 | 7.3 |
| 34 | 70 | 30 | 11.8 | 1.7 | 8.0 | 7.3 |
| 35 | 85 | 15 | 11.2 | 1.9 | 0.1 | 7.8 |

| | | | Properties | | | | |
|---|---|---|---|---|---|---|---|
| Manufacturing No. | Average depth of internal oxide layer μm | Arithmetic average roughness of surface μm | Tensile strength MPa | Toughness (vTrs) ° C. | Chemical convertibility | Coating film adhesion (peeling width) mm | Remarks |
| 18 | 6.9 | 37.1 | 1080 | −55 | OK | 2.4 | Invention Example |
| 19 | 10.4 | 30.0 | 1126 | −55 | OK | 0.8 | Invention Example |
| 20 | 9.2 | 34.8 | 1111 | −50 | OK | 0.8 | Invention Example |
| 21 | 17.2 | 47.2 | 1149 | −50 | OK | 1.0 | Invention Example |
| 22 | 7.2 | 41.9 | 1086 | −60 | OK | 0.9 | Invention Example |
| 23 | 14.8 | 34.9 | 1067 | −65 | OK | 0.5 | Invention Example |
| 24 | 14.1 | 33.9 | 1085 | −60 | OK | 0.1 | Invention Example |
| 25 | 10.0 | 14.1 | 1222 | −50 | OK | 2.6 | Invention Example |
| 26 | 12.8 | 20.8 | 980 | −65 | OK | 0.0 | Invention Example |
| 27 | 5.5 | 33.0 | 1148 | −60 | OK | 1.3 | Invention Example |
| 28 | 19.6 | 33.4 | 998 | −65 | OK | 0.1 | Invention Example |
| 29 | 6.8 | 37.6 | 895 | −30 | OK | 1.3 | Comparative Example |
| 30 | 20.0 | 21.0 | 1422 | −15 | OK | 2.5 | Comparative Example |
| 31 | 13.4 | 37.9 | 1012 | −65 | NG | 7.0 | Comparative Example |
| 32 | 14.9 | 33.5 | 971 | −55 | OK | 0.6 | Comparative Example |
| 33 | 6.4 | 30.0 | 1055 | −60 | NG | 5.6 | Comparative Example |
| 34 | 8.5 | 14.5 | 935 | −35 | OK | 1.6 | Comparative Example |
| 35 | 18.9 | 42.7 | 1679 | −5 | OK | 0.2 | Comparative Example |

INDUSTRIAL APPLICABILITY

According to the present invention, it is possible to obtain a hot-rolled steel sheet which is an ultrahigh-strength steel sheet having a tensile strength of 980 MPa or more, and even in a case where a zirconium-based chemical conversion treatment liquid is used, has chemical convertibility and coating film adhesion equal to or higher than those in a case where a zinc phosphate chemical conversion treatment liquid is used. Since the steel sheet according to the present invention has excellent chemical convertibility and coating film adhesion, the steel sheet has excellent corrosion resistance after coating. Therefore, the present invention is suitable for a component for a vehicle that requires high strength and corrosion resistance after coating.

BRIEF DESCRIPTION OF THE REFERENCE SYMBOLS

1: base metal (steel sheet)
2: scale
3: Ni concentrated portion
4: zirconium-based chemical conversion crystal
5: grain boundary
6: internal oxide

What is claimed is:

1. A hot-rolled steel sheet comprising, as a chemical composition expressed by an average value in an entire sheet thickness direction, by mass %:

C: 0.050% or more and 0.200% or less;
Si: 0.05% or more and 3.00% or less;
Mn: 1.00% or more and 4.00% or less;
Al: 0.001% or more and 2.000% or less;
N: 0.0005% or more and 0.1000% or less;
Ni: 0.02% or more and 2.00% or less;
Nb: 0% or more and 0.300% or less;
Ti: 0% or more and 0.300% or less;
Cu: 0% or more and 2.00% or less;
Mo: 0% or more and 1.000% or less;
V: 0% or more and 0.300% or less;
Cr: 0% or more and 2.00% or less;
Mg: 0% or more and 0.0100% or less;
Ca: 0% or more and 0.0100% or less;
REM: 0% or more and 0.1000% or less;

B: 0% or more and 0.0100% or less;

one or two or more of Zr, Co, Zn, and W: 0% to 1.000% in total;

Sn: 0% to 0.050%;

P: 0.100% or less;

S: 0.0300% or less;

O: 0.0100% or less; and a remainder including Fe and impurities, wherein Expression (1) is satisfied, PCM represented by Expression (2) is 0.20 or more, Ms represented by Expression (3) is 400° C. or higher, in a case where a thickness is denoted by t, a metallographic structure at a t/4 position from a surface contains one or both of tempered martensite and lower bainite at a total volume percentage of 90% or more, a tensile strength is 980 MPa or more, an average Ni concentration on the surface is 7.0% or more, and a standard deviation of an arithmetic average roughness Ra of the surface of the hot-rolled steel sheet is 10.0 μm or more and 50.0 μm or less, $$0.05\% \leq Si+Al \leq 2.50\% \quad \text{Expression (1)}$$

$$PCM=C+Si/30+Mn/20+Cu/20+Ni/60+Mo/15+Cr/20+V/10+5\times B \quad \text{Expression (2)}$$

$$Ms=561-474\times C-33\times Mn-17\times Ni-17\times Cr-21\times Mo \quad \text{Expression (3)}$$

where a symbol of each element shown in the expressions indicates mass % of the element contained in the hot-rolled steel sheet.

2. The hot-rolled steel sheet according to claim 1, wherein the hot-rolled steel sheet contains, as the chemical composition, by mass %, Ni: 0.02% or more, 0.05% or less.

3. The hot-rolled steel sheet according to claim 1, wherein an average number density of iron-based carbides present in the tempered martensite and the lower bainite is $1.0\times10^6$ carbides/mm$^2$ or more.

4. The hot-rolled steel sheet according to claim 1, wherein an internal oxide layer is present in the hot-rolled steel sheet, and an average depth of the internal oxide layer is 5.0 μm or more and 20.0 μm or less from the surface of the hot-rolled steel sheet.

5. The hot-rolled steel sheet according to claim 1, wherein the hot-rolled steel sheet contains, as the chemical composition, by mass %, one or both of B: 0.0001% or more and 0.0100% or less, and Ti: 0.015% or more and 0.300% or less.

6. The hot-rolled steel sheet according to claim 1, wherein the hot-rolled steel sheet contains, as the chemical composition, by mass %, one or two or more of Nb: 0.005% or more and 0.300% or less, Cu: 0.010% or more and 2.00% or less, Mo: 0.010% or more and 1.000% or less, V: 0.010% or more and 0.300% or less, and Cr: 0.01% or more and 2.00% or less.

7. The hot-rolled steel sheet according to claim 1, wherein the hot-rolled steel sheet contains, as the chemical composition, by mass %, one or two or more of Mg: 0.0005% or more and 0.0100% or less, Ca: 0.0005% or more and 0.0100% or less, and REM: 0.0005% or more and 0.1000% or less.

8. A method for manufacturing a hot-rolled steel sheet according to claim 1, the method comprising:

casting a molten steel having the chemical composition according to claim 1 to obtain a slab;

heating the slab in a heating furnace which includes a regenerative-type burner and has at least a preheating zone, a heating zone, and a soaking zone;

hot-rolling the heated slab so that a finish rolling temperature is 850° C. or higher to obtain a hot-rolled steel sheet;

performing primary cooling on the hot-rolled steel sheet to a temperature range equal to or lower than a Ms point temperature calculated by Expression (4) so that an average cooling rate from the finish rolling temperature to the Ms point temperature is 50° C./sec or higher; and coiling the hot-rolled steel sheet at a temperature of lower than 350° C., wherein in the heating of the slab, an air ratio in the preheating zone is 1.1 or more and 1.9 or less, $$Ms=561-474\times C-33\times Mn-17\times Ni-17\times Cr-21\times Mo \quad \text{Expression (4).}$$

9. The method for manufacturing a hot-rolled steel sheet according to claim 8, wherein the primary cooling is stopped at a temperature lower than the Ms point temperature and 350° C. or higher, and the hot-rolled steel sheet after the primary cooling is cooled at a temperature of lower than 350° C. so that a maximum cooling rate is lower than 50° C./sec.

10. The method for manufacturing a hot-rolled steel sheet according to claim 8, wherein in the heating of the slab, an air ratio in the heating zone is 0.9 or more and 1.3 or less.

11. The method for manufacturing a hot-rolled steel sheet according to claim 8, wherein in the heating of the slab, an air ratio in the soaking zone is 0.9 or more and 1.9 or less.

12. The method for manufacturing a hot-rolled steel sheet according to claim 8, wherein the air ratio in the preheating zone is higher than the air ratio in the heating zone.

13. The method for manufacturing a hot-rolled steel sheet according to claim 8, further comprising:

pickling the hot-rolled steel sheet after the coiling of the hot-rolled steel sheet using a 1 to 10 wt % hydrochloric acid solution at a temperature of 20° C. to 95° C. under a condition of a pickling time of 30 seconds or more and less than 60 seconds.

14. The hot-rolled steel sheet according to claim 2, wherein an average number density of iron-based carbides present in the tempered martensite and the lower bainite is $1.0\times10^6$ carbides/mm$^2$ or more.

15. The method for manufacturing a hot-rolled steel sheet according to claim 9, wherein in the heating of the slab, an air ratio in the heating zone is 0.9 or more and 1.3 or less.

16. The method for manufacturing a hot-rolled steel sheet according to claim 9, wherein in the heating of the slab, an air ratio in the soaking zone is 0.9 or more and 1.9 or less.

17. The method for manufacturing a hot-rolled steel sheet according to claim 9, wherein the air ratio in the preheating zone is higher than the air ratio in the heating zone.

* * * * *